US007655370B2

(12) United States Patent
Kitamura et al.

(10) Patent No.: US 7,655,370 B2
(45) Date of Patent: Feb. 2, 2010

(54) ELECTROPHOTOGRAPHIC PHOTOSENSITIVE MEMBER, PROCESS CARTRIDGE, AND ELECTROPHOTOGRAPHIC APPARATUS

(75) Inventors: Wataru Kitamura, Numazu (JP); Hidetoshi Hirano, Suntou-gun (JP); Atsushi Okuda, Yokohama (JP); Harunobu Ogaki, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/179,152

(22) Filed: Jul. 24, 2008

(65) Prior Publication Data

US 2008/0304864 A1 Dec. 11, 2008

Related U.S. Application Data

(63) Continuation of application No. PCT/JP2008/055611, filed on Mar. 18, 2008.

(30) Foreign Application Priority Data

Mar. 27, 2007 (JP) ..... 2007-080967

(51) Int. Cl.
*G03G 15/00* (2006.01)

(52) U.S. Cl. ..... 430/58.05; 430/66

(58) Field of Classification Search ..... 430/58.05, 430/66

See application file for complete search history.

(56) References Cited

U.S. PATENT DOCUMENTS 6,416,915 B1 * 7/2002 Kikuchi et al. ..... 430/56
2005/0181292 A1 * 8/2005 Fujii et al. ..... 430/72
2007/0059619 A1 * 3/2007 Shimoyama et al. ..... 430/58.7
2007/0065741 A1 * 3/2007 Iemura et al. ..... 430/60
2007/0077507 A1 * 4/2007 Otsubo et al. ..... 430/60

FOREIGN PATENT DOCUMENTS

| | | |
|---|---|---|
| JP | 02-187784 | 7/1990 |
| JP | 05-323639 | 12/1993 |
| JP | 09-090650 | 4/1997 |
| JP | 10-142813 | 5/1998 |
| JP | 11-249333 | 9/1999 |
| JP | 2000-075517 | 3/2000 |

(Continued)

OTHER PUBLICATIONS

Translation of IPRP for PCT/JP2008/055611, dated Oct. 8, 2009, 13 pages.

*Primary Examiner*—Hoa V Le
(74) *Attorney, Agent, or Firm*—Fitzpatrick, Cella, Harper & Scinto

(57) ABSTRACT

Provided is an electrophotographic photosensitive member in which friction memory does not easily occur, and a process cartridge and an electrophotographic apparatus which have the electrophotographic photosensitive member. The electrophotographic photosensitive member having a photosensitive layer has a surface layer having a plurality of depressed portions which are independent from one another, where the minor axis diameter of the depressed portions is Rpc and the depth indicating the distance between the innermost part of a depressed portion and the opening surface thereof is Rdv, the depressed portions have a ratio of depth to minor axis diameter (Rdv/Rpc) on a surface of the photosensitive member of 1.0 or less, and the photosensitive layer has a charge transporting material with an ionization potential of 4.5 eV or more and 5.3 eV or less.

9 Claims, 11 Drawing Sheets

FOREIGN PATENT DOCUMENTS

| | | |
|---|---|---|
| JP | 2001-066814 | 3/2001 |
| JP | 2003-005411 | 1/2003 |
| JP | 2003-118187 | 8/2003 |
| JP | 2004-220931 | 8/2004 |
| JP | 2007-072277 | 3/2007 |
| WO | WO 2005/093518 A1 | 10/2005 |

* cited by examiner

ELECTROPHOTOGRAPHIC PHOTOSENSITIVE MEMBER, PROCESS CARTRIDGE, AND ELECTROPHOTOGRAPHIC APPARATUS

This application is a continuation of International Application No. PCT/JP2008/055611, filed on Mar. 18, 2008, which claims the benefit of Japanese Patent Application No. 2007-080967 filed on Mar. 27, 2007.

BACKGROUND OF THE INVENTION

1. Field of the Invention

The present invention relates to an electrophotographic photosensitive member, and a process cartridge and an electrophotographic apparatus which have the electrophotographic photosensitive member.

2. Description of the Related Art

Due to advantages such as low price and high productivity, electrophotographic photosensitive members providing a photosensitive layer (organic photosensitive layer) which uses an organic material as a photoconductive material (a charge generating material and a charge transporting material), a so-called "organic electrophotographic photosensitive member", on a support are becoming more widespread as an electrophotographic photosensitive member. Due to advantages such as high sensitivity and variety in material design, electrophotographic photosensitive members having a multi-layer photosensitive layer composed of a charge generating layer containing a charge generating material and a charge transporting layer containing a charge transporting material, a so-called "multi-layer photosensitive layer", predominate for organic electrophotographic photosensitive members. Examples of the charge generating material include photoconductive dyes and photoconductive pigments. Examples of the charge transporting material include photoconductive polymers and photoconductive low-molecular weight compounds.

Electrophotographic photosensitive members are subjected to direct application of electrical external forces and/or mechanical external forces on their surface, such as of charging, exposure, development, transfer and cleaning, and hence are required to have resistance to these. Specifically, electrophotographic photosensitive members are required to have durability against the scratching and wear of a surface caused by a cleaning blade or paper, friction memory properties against light, friction memory properties against frictional electrification with abutting members, resistance to cracks and depressions caused by abutting members, and adhesion resistance to toner.

One of the various above-described problems is the phenomenon of "friction memory". This phenomenon is one memory phenomenon which is caused by plus charge being generated on a photosensitive member surface as a result of the photosensitive member and a charge member or cleaning blade abutting the photosensitive member rubbing against each other when subjected to vibration from distribution or receiving a shock from a fall.

In view of such a problem, Japanese Patent Application Laid-Open No. H10-142813 discusses a technique for reducing the friction with a cleaning blade by introducing a phenyl group which has fluorines substituted on the terminals of the binder. Japanese Patent Application Laid-Open No. 2000-075517 discusses a technique for suppressing the occurrence of memory by combining a charge transporting material with a specific structure and a polycarbonate resin with a specific structure.

Further, from the perspective of reducing the friction between a photosensitive member and a charge member or blade, changing the surface profile of the photosensitive member can be thought of as one means. For example, Japanese Patent Application Laid-Open No. 2001-066814 discusses a technique for subjecting the surface of an electrophotographic photosensitive member to compression molding using a stamper provided with well-shaped uneven portions.

SUMMARY OF THE INVENTION

However, even when the electrophotographic photosensitive members described in Japanese Patent Applications Laid-Open No. H10-142813 and No. 2000-075517 are used, memory sometimes still occurs due to friction with the charge member in particular under more severe conditions. Thus, there is a need for further improvement.

Further, when the electrophotographic photosensitive member described in Japanese Patent Application Laid-Open No. 2001-066814 which had been slightly modified is used, for a photosensitive member with shallow depressed portions, the contact area between the photosensitive member surface and the elastic charge member or cleaning blade cannot be reduced. As a result, the effects of suppressing friction memory may not be obtained.

It is an object of the present invention to provide an electrophotographic photosensitive member in which friction memory does not easily occur, and a process cartridge and an electrophotographic apparatus which have the electrophotographic photosensitive member.

As a result of intensive investigations, the present inventors discovered that the above-described problems could be effectively improved upon by having in the surface of an electrophotographic photosensitive member specific depressed portions and a specific hole transporting material, thereby arriving at the present invention.

Specifically, the electrophotographic photosensitive member of the present invention relates to an electrophotographic photosensitive member having a photosensitive layer on a support, wherein the electrophotographic photosensitive member has 100 or more depressed portions which are independent from one another per unit area (100 μm×100 μm) over the whole surface of a surface layer, where the minor axis diameter of the depressed portions is Rpc and the depth indicating the distance between the innermost part of a depressed portion and the opening surface thereof is Rdv, the depressed portions have a ratio of depth to minor axis diameter (Rdv/Rpc) of 1.0 or less, and the photosensitive layer includes a hole transporting material with an ionization potential of 4.5 eV or more and 5.3 eV or less.

The present invention also relates to a process cartridge, integrally supporting on a support the above-described electrophotographic photosensitive member and at least one device selected from the group consisting of a charging device, a developing device and a cleaning device, the process cartridge being freely detachable/mountable to a main body of an electrophotographic apparatus.

The present invention also relates to an electrophotographic apparatus including the above-described electrophotographic photosensitive member, a charging device, an exposure device, a developing device and a transfer device.

The electrophotographic photosensitive member of the present invention can provide an electrophotographic photosensitive member in which friction memory does not easily occur, and a process cartridge and an electrophotographic apparatus which have the electrophotographic photosensitive member.

Further features of the present invention will become apparent from the following description of exemplary embodiments with reference to the attached drawings.

DESCRIPTION OF THE EMBODIMENTS

The present invention will now be described in more detail.

The electrophotographic photosensitive member of the present invention is, as described above, an electrophotographic photosensitive member having a photosensitive layer on a support, wherein the electrophotographic photosensitive member has a surface layer having a plurality of depressed portions which are independent from one another, where the minor axis diameter of the depressed portions is Rpc and the depth indicating the distance between the innermost part of a depressed portion and the opening surface thereof is Rdv, the depressed portions have a ratio of depth to minor axis diameter (Rdv/Rpc) on a surface of the photosensitive member of 1.0 or less, and the photosensitive layer has a hole transporting material with an ionization potential of 4.5 eV or more and 5.3 eV or less.

Figure 1A:
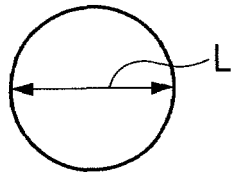
FIG. 1A is a view illustrating an example of the shape of a depressed portion (top view) in the present invention.
Figure 1B:
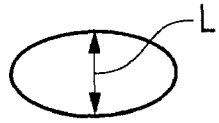
FIG. 1B is a view illustrating an example of the shape of a depressed portion (top view) in the present invention.
Figure 1C:
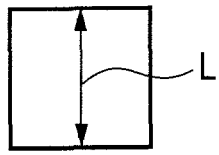
FIG. 1C is a view illustrating an example of the shape of a depressed portion (top view) in the present invention.

"Depressed portions which are independent from one another" in the present invention refers to the state where each depressed portion is clearly defined from other depressed portions. The depressed portions formed on the surface of the electrophotographic photosensitive member in the present invention may be, when the photosensitive member is observed from a top view, for example, a shape including straight lines, a shape including curved lines, and a shape including straight lines and curved lines. Examples of depressed portions of the photosensitive member surface are illustrated in FIGS. 1A to 1G. Examples of shapes constituted by straight lines include triangles (FIG. 1E), quadrangles (FIGS. 1C and 1D), pentagons (FIG. 1F) and hexagons (FIG. 1G). Examples of shapes constituted by curved lines include circles (FIG. 1A) and ellipses (FIG. 1B). Examples of shapes constituted by straight lines and curved lines include quadrangles with round corners, hexagons with round corners and sectors. Further, the depressed portions formed on the surface of the electrophotographic photosensitive member in the present invention may be, when the photosensitive member is observed from a cross section, for example, a shape constituted by straight lines, a shape constituted by curved lines, and a shape constituted by straight lines and curved lines. Examples of shapes constituted by straight lines include triangles, quadrangles and pentagons. Examples of shapes constituted by curved lines include partial circles and partial ellipses. Examples of shapes constituted by straight lines and curved lines include quadrangles with round corners and sectors. Specific examples of the depressed portions of the electrophotographic photosensitive member surface in the present invention include the depressed portions illustrated in FIGS. 1A to 1G (examples of the shape of depressed portions (top views)) and FIGS. 2A to 2G (examples of the shape of depressed portions (cross sections)). From the standpoint of friction memory properties, the cross-sectional profile of the depressed portions of the electrophotographic photosensitive member surface in the present invention desirably has an area when viewed from the photosensitive member which is at its largest at the surface openings and smaller in the interior, such as a needle, quadrangular pyramid, triangular pyramid and semicircle. The depressed portions of the electrophotographic photosensitive member surface in the present invention may individually have different shapes, sizes and depths. The depressed portions may also all have the same shape, size and depth. The surface of the electrophotographic photosensitive member may further be a surface which combines depressed portions which individually have different shapes, sizes and depths and depressed portions which have the same shape, size and depth.

The above depressed portions are formed at least on the surface of the electrophotographic photosensitive member. The depressed portion region of the photosensitive member surface may be over the whole surface on the surface layer, or the depressed portions may be formed on a part of the surface. However, forming the depressed portions over the whole surface is desirable from the standpoint of friction memory properties.

Figure 1D:
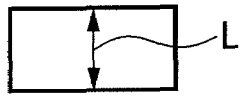
FIG. 1D is a view illustrating an example of the shape of a depressed portion (top view) in the present invention.
Figure 1E:
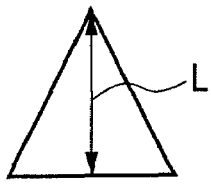
FIG. 1E is a view illustrating an example of the shape of a depressed portion (top view) in the present invention.
Figure 1F:
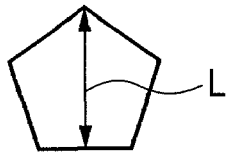
FIG. 1F is a view illustrating an example of the shape of a depressed portion (top view) in the present invention.
Figure 1G:
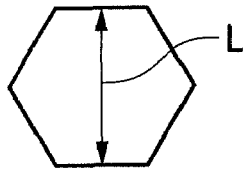
FIG. 1G is a view illustrating an example of the shape of a depressed portion (top view) in the present invention.
Figure 2A:
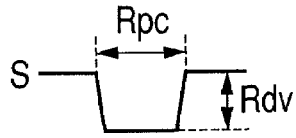
FIG. 2A is a view illustrating an example of the shape of a depressed portion (cross section) in the present invention.
Figure 2B:
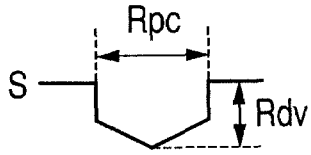
FIG. 2B is a view illustrating an example of the shape of a depressed portion (cross section) in the present invention.
Figure 2C:
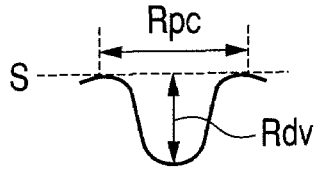
FIG. 2C is a view illustrating an example of the shape of a depressed portion (cross section) in the present invention.
Figure 2D:
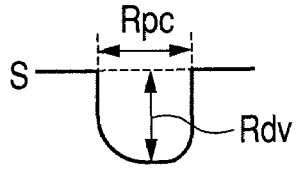
FIG. 2D is a view illustrating an example of the shape of a depressed portion (cross section) in the present invention.
Figure 2E:
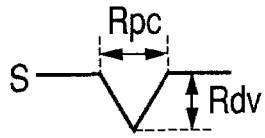
FIG. 2E is a view illustrating an example of the shape of a depressed portion (cross section) in the present invention.
Figure 2F:
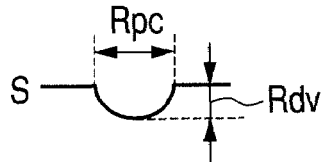
FIG. 2F is a view illustrating an example of the shape of a depressed portion (cross section) in the present invention.
Figure 2G:
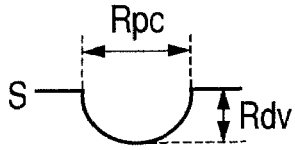
FIG. 2G is a view illustrating an example of the shape of a depressed portion (cross section) in the present invention.

"Minor axis diameter" in the present invention refers to, as illustrated by the length (L) indicated by the arrow in FIGS. 1A to 1G and by the minor axis diameter (Rpc) in FIGS. 2A to 2G, the minimum length across a depressed portion, on the basis of the surface that surrounds the openings of the depressed portions in the electrophotographic photosensitive member. For example, where a depressed portion has an opening shape of a circle, the minor axis diameter refers to the diameter (FIG. 1A); where a depressed portion has an opening shape of an ellipse, it refers to the minor axis (FIG. 1B); and where a depressed portion has an opening shape of a rectangle, it refers to the short side (FIG. 1D).

"Depth" in the present invention refers to the distance between the innermost part of each depressed portion and the opening surface thereof. Specifically, as illustrated by the depth Rdv in FIGS. 2A to 2G, it refers to the distance between the innermost part of each depressed portion and the opening surface thereof, on the basis of the surface (standard surface (S)) that surrounds the openings of the depressed portions in the electrophotographic photosensitive member.

The electrophotographic photosensitive member of the present invention has the above-described depressed portions on its surface, wherein the depressed portions have a ratio of depth (Rdv) to minor axis diameter (Rpc) (Rdv/Rpc) of 1.0 or less. This shows that it is an electrophotographic photosensitive member whose surface has depressed portions having a smaller depth than the minor axis diameter. By employing an electrophotographic photosensitive member such as that of the present invention, which has on its surface depressed portions having a smaller depth than the minor axis diameter, friction memory does not easily occur, and thus image defects resulting from friction memory are suppressed. Although the reason for that is not clear, it is thought that this is as a result of having on the surface of the electrophotographic photosensitive member depressed portions which have a smaller depth than the minor axis diameter, and a hole transporting material with an ionization potential of 5.3 eV or less, whereby the plus charge generated by the friction with the charge member or cleaning blade can be efficiently reduced. Since the depressed portions of the present invention have a smaller depth than the minor axis diameter, although the contact pressure with the elastic charge member or cleaning blade is reduced, generally these members can be kept in contact with the abutting members. If members brush against each other in this state, the occurrence of plus charge at the portions having the depressed portions is reduced. However, plus charge is generated over the whole photosensitive member surface in contact with a contacting member. As a result of having depressed portions which are each independent from one another, the electrophotographic photosensitive member of the present invention has a larger surface area than typical photosensitive members, so that the plus charge is generated over a broader region. The present inventors discovered that by using a hole transporting material with an ionization potential of 5.3 eV or less, the plus charge generated on the surface of a photosensitive member having a large surface area could be effectively reduced, thereby arriving at the present invention.

From the standpoint of friction memory properties, the ratio of depth Rdv to minor axis diameter Rpc (Rdv/Rpc) of the depressed portions of the electrophotographic photosensitive member surface is desirably 1.0 or less. Even more desirably from the standpoint of friction memory properties, the ratio of depth Rdv to minor axis diameter Rpc (Rdv/Rpc) of the depressed portions of the electrophotographic photosensitive member surface is 0.10 or more and 0.40 or less. If the ratio of depth Rdv to minor axis diameter Rpc (Rdv/Rpc) of the depressed portions of the electrophotographic photosensitive member surface is more than 1.0, the contact area with the elastic charge member or cleaning blade is reduced, and the surface area over which plus charge is generated by the friction with a contacting member is reduced. As a result, it becomes more difficult to obtain the effects of a reduction in plus charge from the combination of the depressed portions and the hole transporting material of the present invention.

On the surface of the electrophotographic photosensitive member of the present invention, it is desirable to have 100 or more of the above-described depressed portions having a ratio of depth to minor axis diameter (Rdv/Rpc) of 1.0 or less per 100 μm square, specifically per unit area (100 μm×100 μm). By having a large number of specific depressed portions per unit area, the electrophotographic photosensitive member has good friction memory properties due to the synergistic effects with the hole transporting material with an ionization potential of 5.3 eV or less. Further, it is desirable to have 250 or more of the depressed portions having a ratio of depth to minor axis diameter (Rdv/Rpc) of 1.0 or less per 100 μm square, specifically per unit area (100 μm×100 μm), and more desirably 250 or more and 1,000,000 or less. In addition, depressed portions which do not have the above-described ratio of depth to minor axis diameter (Rdv/Rpc) of 1.0 or less may also be contained in the unit area on the surface of the electrophotographic photosensitive member.

Further, although the depth of the depressed portions of the electrophotographic photosensitive member of the present invention may be freely set within the range of a ratio of depth to minor axis diameter (Rdv/Rpc) of 1.0 or less, from the standpoint of good friction memory properties, it is desirable to set the depth Rdv of the depressed portions to 0.01 μm or more and 3.00 μm or less. In addition, from the standpoint of good friction memory properties, it is more desirable to set the depth Rdv of the depressed portions to 0.05 μm or more and 1.20 μm or less.

The depressed portions having a ratio of depth to minor axis diameter (Rdv/Rpc) of 1.0 or less in the surface of the electrophotographic photosensitive member of the present invention may be of any arrangement. Specifically, the depressed portions having a ratio of depth to minor axis diameter (Rdv/Rpc) of 1.0 or less may be arranged at random, or may be arranged with regularity. In order to improve surface uniformity to friction memory properties, it is desirable for the depressed portions to be arranged with regularity.

In the present invention, the depressed portions of the surface of the electrophotographic photosensitive member may be observed, for example, on a commercially available laser microscope, optical microscope, electron microscope or atomic force microscope.

As the laser microscope, the following equipment may be used, for example: an ultradepth profile measuring microscope VK-8550, an ultradepth profile measuring microscope VK-9000 and an ultradepth profile measuring microscope VK-9500 (all manufactured by Keyence Corporation), a profile measuring system Surface Explorer SX-520DR model instrument (manufactured by Ryoka Systems Inc.), a scanning confocal laser microscope OLS3000 (manufactured by Olympus Corporation), and a real-color confocal microscope OPTELICS C130 (manufactured by Lasertec Corporation).

As the optical microscope, the following equipment may be used, for example: a digital microscope VHX-500 and a digital microscope VHX-200 (both manufactured by Keyence Corporation) and a 3D digital microscope VC-7700 (manufactured by Omron Corporation).

As the electron microscope, the following equipment may be used, for example: a 3D real surface view microscope VE-9800 and a 3D real surface view microscope VE-8800 (both manufactured by Keyence Corporation), a scanning electron microscope Conventional/Variable Pressure SEM (manufactured by SII Nano Technology Inc.), and a scanning electron microscope Super Scan SS-550 (manufactured by Shimadzu Corporation).

As the atomic force microscope, the following equipment may be used, for example: a nanoscale hybrid microscope VN-8000 (manufactured by Keyence Corporation), a scanning probe microscope NanoNavi Station (manufactured by SII Nano Technology Inc.), and a scanning probe microscope SPM-9600 (manufactured by Shimadzu Corporation).

The minor axis diameter and depth of the depressed portions in the measurement visual field may be measured at certain magnifications using an above-described microscope. Further, the opening area ratio of the depressed portions per unit area may be found by calculation.

A measurement example will now be described in which the measurement is carried out utilizing an analytical program by the Surface Explorer SX-520DR model instrument. A measuring object electrophotographic photosensitive member is placed on a work stand. The tilt is adjusted to bring the stand to level, and three-dimensional profile data of the peripheral surface of the electrophotographic photosensitive member is entered in a wave mode. Here, the objective lens may be set at 50-times magnification under observation in a visual field of 100 μm×100 μm $\mu m^2$).

Next, contour line data of the surface of the electrophotographic photosensitive member is displayed by using a particle analytical program in the data analytical software.

Hole analytical parameters of depressed portions, such as the profile, minor axis diameter, depth and opening area of the depressed portions, may each be optimized according to the depressed portions formed. For example, where depressed portions of about 10 μm in minor axis diameter are observed and measured, the minor axis diameter upper limit may be set at 15 μm, the minor axis diameter lower limit at 1 μm, the depth lower limit at 0.1 μm and the volume lower limit at 1 $\mu m^3$ or more. The number of depressed portions distinguishable as depressed portions on the analysis screen is counted, and the resultant value is regarded as the number of the depressed portions.

Under the same visual field and analytical conditions as the above, the total opening area of the depressed portions may be calculated from the total of the opening areas of the respective depressed portions found by using the above particle analytical program. The opening area ratio of the depressed portions (hereinafter, what is simply noted as "area ratio" refers to this opening area ratio) can be calculated from the following formula.

[Total opening area of depressed portions/(total opening area of depressed portions+total area of non-depressed-portions)]×100(%)

From the standpoint of good friction memory properties, it is desirable to have 16% or more in terms of depressed portion opening area ratio of the depressed portions whose ratio of depth to minor axis diameter (Rdv/Rpc) is 1.0 or less in the surface of the electrophotographic photosensitive member. Even more desirably from the standpoint of good friction memory properties is to have 20% or more and 50% or less in terms of depressed portion opening area ratio of the depressed portions whose ratio of depth to minor axis diameter (Rdv/Rpc) is 1.0 or less in the surface of the electrophotographic photosensitive member.

Further, regarding depressed portions having a minor axis diameter of about 1 μm or less, such portions may be measured with a laser microscope and an optical microscope. However, if the measurement precision needs to be greater, it is desirable to combine the observation and measurement using an electron microscope.

Next, how the surface of the electrophotographic photosensitive member according to the present invention is formed will be described. The method for forming surface profiles is not particularly limited, as long as the method can satisfy the above-described requirements concerning the depressed portions. Examples of the method for forming the surface of the electrophotographic photosensitive member include forming the surface of the electrophotographic photosensitive member by laser irradiation having output characteristics of a pulse width of 100 ns (nanoseconds) or less, forming the surface by bringing a mold having a certain profile into pressure contact with the surface of the electrophotographic photosensitive member to thereby transfer the profile, and forming the surface by causing condensation to take place on the surface of the electrophotographic photosensitive member when its surface layer is formed.

The method of forming the surface of the electrophotographic photosensitive member by laser irradiation having output characteristics of a pulse width of 100 ns (nanoseconds) or less will be described. Specific examples of the laser used in this method include an excimer laser employing a gas such as ArF, KrF, XeF or XeCl as the laser medium, and a femtosecond laser employing titanium sapphire as the laser medium. Further, the laser light in the above laser irradiation can have a wavelength of 1,000 nm or less.

The above-described excimer laser is a laser from which the light is emitted through the following steps. First, a mixed gas of a rare gas such as Ar, Kr and Xe and a halogen gas such as F and Cl is energized by, for example, discharge, electron beams and X-rays to excite and combine the above elements. Then, the energy comes down to the ground state to cause dissociation, during which the excimer laser light is emitted. Examples of the gas used in the excimer laser include ArF, KrF, XeCl and XeF, any of which may be used in the excimer laser. In particular, KrF or ArF is desirable.

Figure 3:
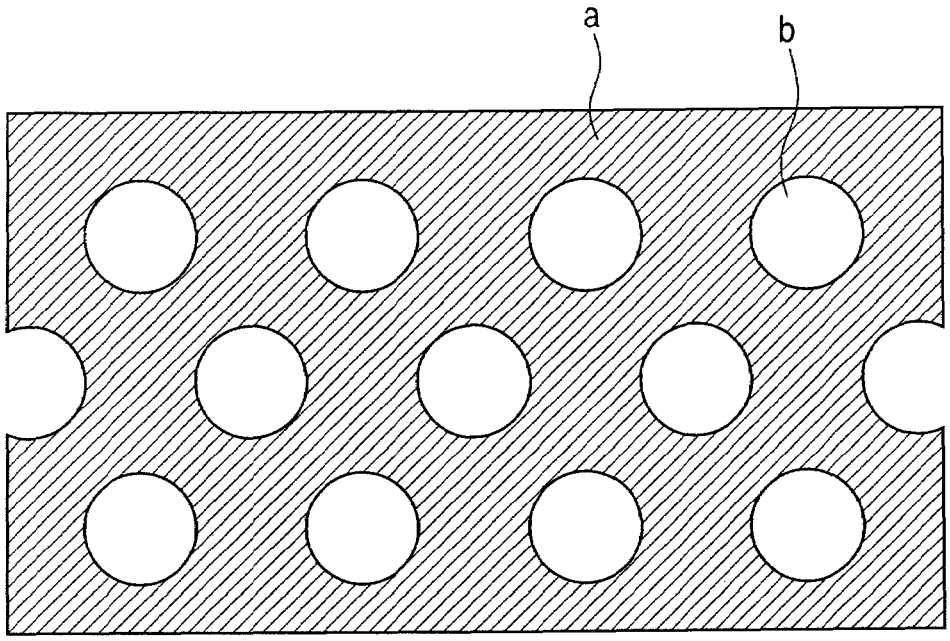
FIG. 3 is a view illustrating an example of a mask array pattern (partial enlarged view) in the present invention.
Figure 4:
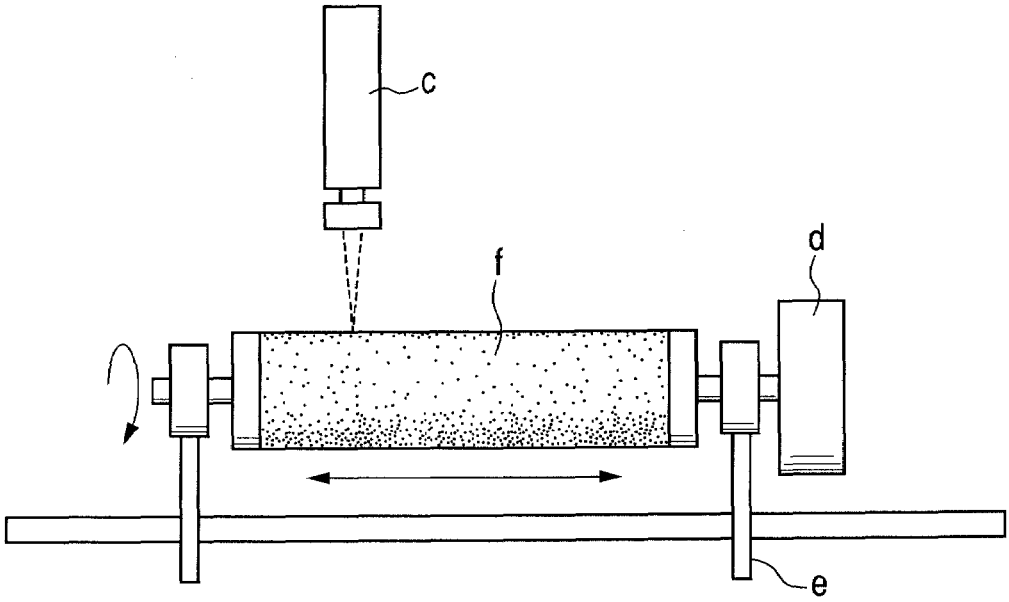
FIG. 4 is a schematic view illustrating an example of a laser processing apparatus in the present invention.

The method of forming the depressed portions is carried out using a mask in which laser light shielding areas a and laser light transmitting areas b are appropriately arranged as illustrated in FIG. 3. Just the laser light which has passed through the mask is converged with a lens, and the surface of the electrophotographic photosensitive member is irradiated with that light. This enables depressed portions having a desired shape and arrangement to be formed. In the above method for forming the surface of the electrophotographic photosensitive member by laser irradiation, a large number of depressed portions within a fixed area can be instantly and simultaneously processed regardless of the shape or area of the depressed portions. Thus, the surface forming step can be carried out in a short time. As a result of the laser irradiation using such a mask, the surface of the electrophotographic photosensitive member is processed in the region of from several $mm^2$ to several $cm^2$ per irradiation. As illustrated in FIG. 4, in laser processing, first, an electrophotographic photosensitive member f is rotated by a work rotating motor d. While rotating the electrophotographic photosensitive member f, the laser irradiation position is shifted in the axial direction of the electrophotographic photosensitive member by a work moving apparatus e. This enables the depressed portions to be efficiency formed across the whole surface of the electrophotographic photosensitive member by irradiating excimer laser light from an excimer laser light irradiator c.

The above-described method of forming the surface of the electrophotographic photosensitive member by laser irradiation can produce an electrophotographic photosensitive member having a surface layer with a plurality of depressed portions which are independent from one another, where the minor axis diameter of the depressed portions is Rpc and the depth indicating the distance between the innermost part of a depressed portion and the opening surface thereof is Rdv, the depressed portions have a ratio of depth to minor axis diameter (Rdv/Rpc) of 1.0 or less. The depressed portions may have any depth within the above range. If the surface of the electrophotographic photosensitive member is formed by laser irradiation, the depth of the depressed portions may be controlled by adjusting the production conditions such as laser irradiation duration and number of times. From the viewpoint of precision in manufacture or productivity, if the surface of the electrophotographic photosensitive member is formed by laser irradiation, the depth of depressed portions formed by one irradiation may be 0.01 μm or more and 2.0 μm or less, and desirably 0.01 μm or more and 1.2 μm or less. Using a method of forming the surface of the electrophotographic photosensitive member by laser irradiation enables the realization of surface processing of the electrophotographic photosensitive member which has a high level of control for the size, shape and arrangement of the depressed portions, with high precision and at a high degree of freedom.

Figure 5:
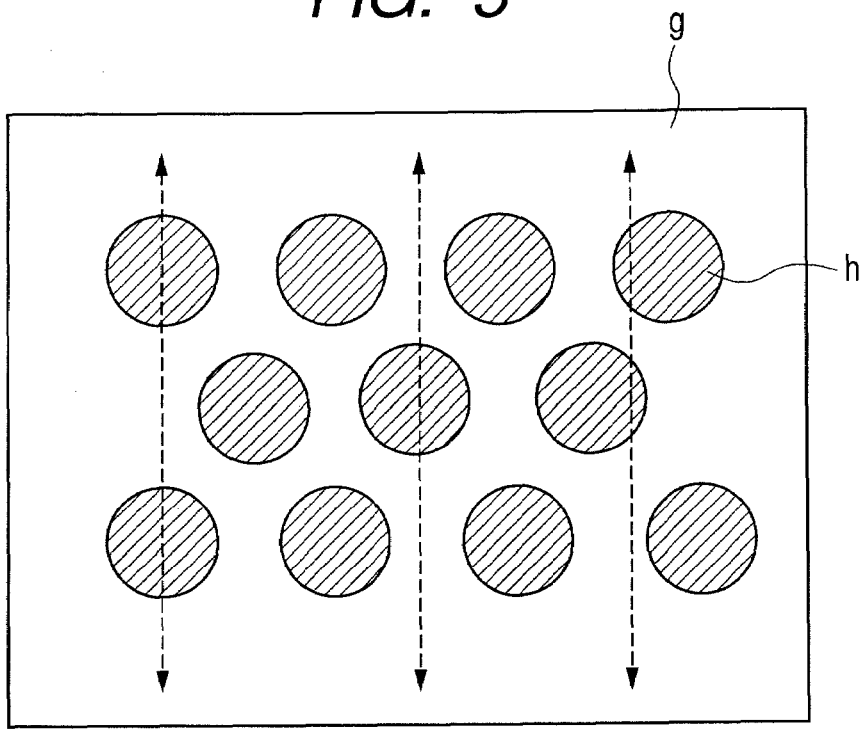
FIG. 5 is a view illustrating an example of an array pattern of depressed portions (partial enlarged view) of the photosensitive member outermost surface obtained according to the present invention.

In the method of forming the surface of the electrophotographic photosensitive member by laser irradiation, the surface forming method may be applied to a plurality of portions or over the whole photosensitive member surface by using the same mask pattern. This way of forming enables the depressed portions to be formed with high uniformity over the whole photosensitive member surface. As a result, the effects of a reduction in friction memory on the abutting portion between the electrophotographic photosensitive member and the charge member or cleaning blade can be uniform. Also, as illustrated in FIG. 5, localized friction memory can be prevented even more by forming the mask pattern in an array in which both the depressed portions h and non-depressed-portions g are present on arbitrary lines (the dotted arrows of FIG. 5) in a peripheral direction of the photosensitive member.

To make the effects of a reduction in friction memory even more uniform, a heating step may be carried out after the depressed portions have been formed. The heating temperature is desirably set at not less than 100° C. From the standpoint of friction memory, the upper limit of the heating temperature is not particularly limited. However, from the standpoint of electrophotographic properties, the heating temperature is desirably not more than 150° C.

Next, the method of forming the surface by bringing a mold having a certain profile into pressure contact with the surface of the electrophotographic photosensitive member to thereby transfer the profile will be described.

Figure 6:
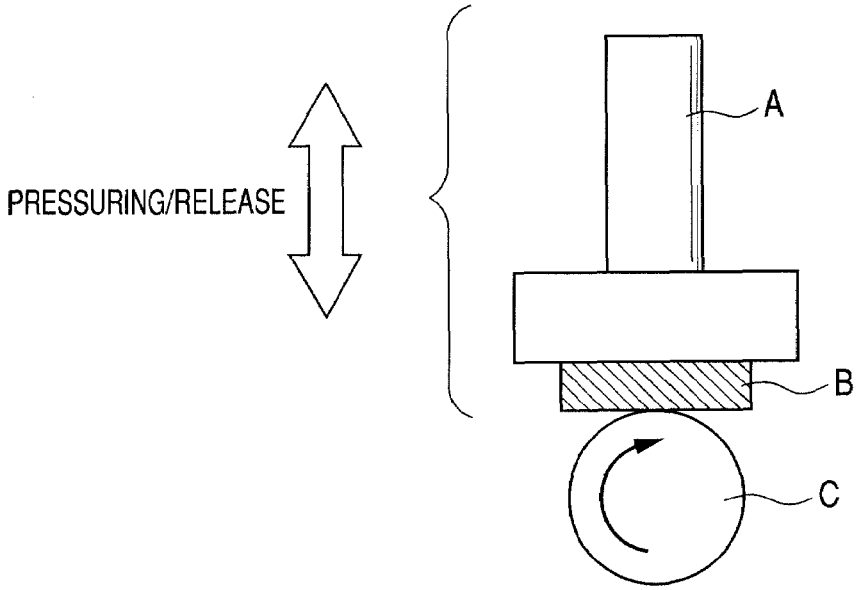
FIG. 6 is a schematic view illustrating an example of a pressure contact type profile transfer processing apparatus using a mold in the present invention.

FIG. 6 is a schematic view illustrating an example of a pressure contact type profile transfer processing apparatus using a mold in the present invention. A certain mold B is fitted to a pressuring unit A which can repeatedly perform pressuring and release, and thereafter brought into contact with a photosensitive member C at a certain pressure to transfer a profile. Then, the pressuring is first released and the photosensitive member C is rotated. Pressure is then again applied to carry out the step of transferring the profile. Repeating this step enables the formation of certain depressed portions over the whole periphery of the photosensitive member.

Figure 7:
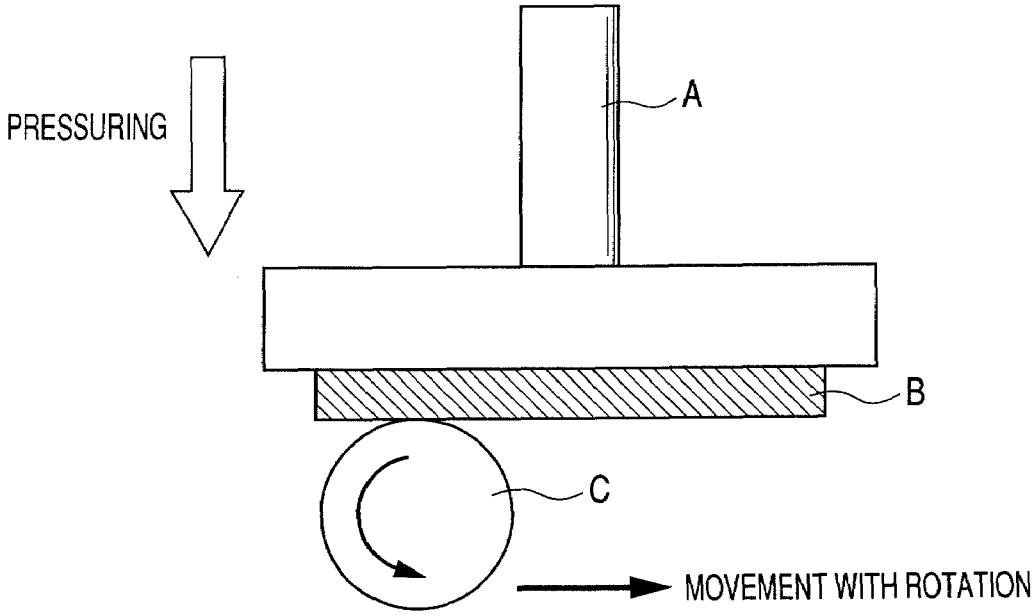
FIG. 7 is a view illustrating another example of a pressure contact type profile transfer processing apparatus using a mold in the present invention.

Alternatively, as illustrated in FIG. 7 for example, a mold B having a certain surface profile with a length corresponding approximately to the whole circumference of the surface of the photosensitive member C may be fitted to the pressuring unit A, and then brought into contact with the photosensitive member C at a certain pressure, during which time the photosensitive member is rotated and moved, to form certain depressed portions over the whole periphery of the photosensitive member.

Further, a sheet-like mold may be held between a roll-shaped pressuring unit and the photosensitive member so that the surface of the photosensitive member is processed while feeding the mold sheet.

For the purpose of transferring the surface profile efficiently, the mold and the photosensitive member may be heated. Although the heating temperature of the mold and the photosensitive member may be arbitrarily set in a range in which the surface profile of the photosensitive member according to the present invention can be formed, the heating is desirably carried out so that the temperature (° C.) of the mold at the time of profile transfer is higher than the glass transition temperature (° C.) of the photosensitive layer on the support. Further, in addition to heating the mold, the temperature (° C.) of the support at the time of profile transfer may be controlled so as to be lower than the glass transition temperature (° C.) of the photosensitive layer. This is desirable in order to stably form the depressed portions transferred to the photosensitive member surface.

If the photosensitive member of the present invention is a photosensitive member having a charge transporting layer, it is desirable to heat the mold so that its temperature (° C.) at the time of profile transfer is higher than the glass transition temperature (° C.) of the charge transporting layer on the support. Further, in addition to heating the mold, the temperature (° C.) of the support at the time of profile transfer may be controlled so as to be lower than the glass transition temperature (° C.) of the charge transporting layer. This is desirable in order to stably form the depressed portions transferred to the photosensitive member surface.

Further, in the present invention, to make the effects of a reduction in friction memory even more uniform, the heating temperature of the mold at the time of profile transfer is desirably 100° C. or more.

Figure 8A:
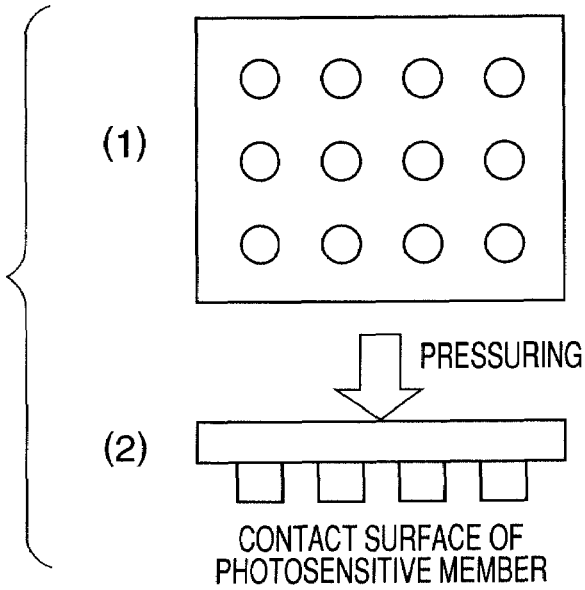
FIG. 8A is a view illustrating an example of the profile of a mold in the present invention.
Figure 8B:
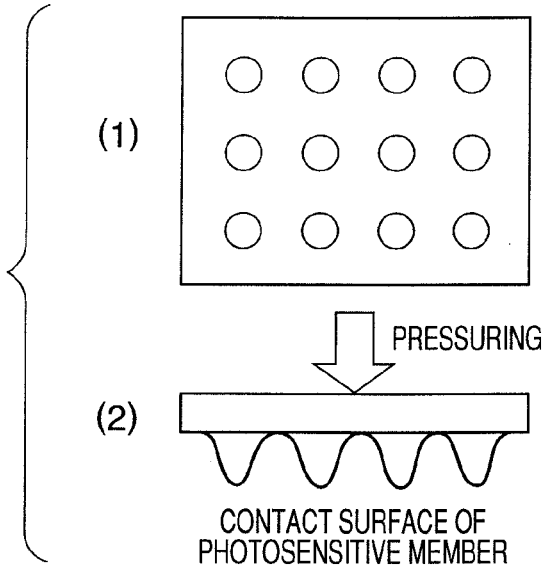
FIG. 8B is a view illustrating an example of the profile of a mold in the present invention.

The material, size and surface profile of the mold itself may be appropriately selected. Examples of the material include finely surface-processed metals and silicon wafers whose surfaces have been patterned using a resist, and fine-particle-dispersed resin films and resin films having a certain fine surface profile which have been coated with a metal. Examples of the mold surface profile are illustrated in FIGS. 8A and 8B In FIGS. 8A and 8B, (1) is a view of the mold profile as seen from above, and (2) is a view of the mold profile as seen from the side.

Further, an elastic member may be provided between the mold and the pressuring unit for the purpose of providing the electrophotographic photosensitive member with pressure uniformity.

The above-described method of forming the surface by bringing a mold having a certain profile into pressure contact with the surface of the electrophotographic photosensitive member to thereby transfer the profile can produce an electrophotographic photosensitive member having a surface layer with a plurality of depressed portions which are independent from one another, where the minor axis diameter of the depressed portions is Rpc and the depth indicating the distance between the innermost part of a depressed portion and the opening surface thereof is Rdv, the depressed portions have a ratio of depth to minor axis diameter (Rdv/Rpc) of 1.0 or less. The depressed portions may have any depth within the above range. If the surface of the electrophotographic photosensitive member is formed by bringing a mold having a certain profile into pressure contact with the surface of the electrophotographic photosensitive member to thereby transfer the profile, the depth of the depressed portions is desirably 0.01 μm or more and 3.00 μm or less. Using a method of forming the surface of the electrophotographic photosensitive member by bringing a mold having a certain profile into pressure contact with the surface of the electrophotographic photosensitive member to thereby transfer the profile enables the realization of surface processing of the electrophotographic photosensitive member which has a high level of control for the size, shape and arrangement of the depressed portions, with high precision and at a high degree of freedom.

Next, the method of forming the surface by causing condensation to take place on the surface of the electrophotographic photosensitive member when its surface layer is formed will be described. "Method of forming the surface by causing condensation to take place on the surface of the electrophotographic photosensitive member when its surface layer is formed" refers to a method of forming the electrophotographic photosensitive member, including a coating step in which a surface layer coating solution containing a binder resin and a specific aromatic organic solvent is prepared and applied, the aromatic organic solvent being contained in an amount of from 50% by mass or more and 80% by mass or less based on the total mass of the solvent in the surface layer coating solution, followed by a condensation step in which a support applied with the coating solution is held and condensation is caused to take place on the surface of the support applied with the coating solution, and then a subsequent drying step for heating and drying the support to produce a surface layer having depressed portions independent from one another formed on its surface.

Examples of the binder resin include acrylic resins, styrene resins, polyester resins, polycarbonate resins, polyarylate resins, polysulfone resins, polyphenylene oxide resins, epoxy resins, polyurethane resins, alkyd resins and unsaturated resins. In particular, polymethyl methacrylate resins, polystyrene resins, styrene-acrylonitrile copolymer resins, polycarbonate resins, polyarylate resins and diallyl phthalate resins are desirable. Polycarbonate resins or polyarylate resins are even more desirable. These may be used alone, or in the form of a mixture or copolymer of two or more types.

The above specific aromatic organic solvent is a solvent having a low affinity for water. Specific examples include one of 1,2-dimethylbenzene, 1,3-dimethylbenzene, 1,4-dimethylbenzene, 1,3,5-trimethylbenzene and chlorobenzene.

It is important that the above surface layer coating solution contains the aromatic organic solvent. The surface layer coating solution may further contain an organic solvent having a high affinity for water, or water, for the purpose of producing the depressed portions stably. Desirable examples of the organic solvent having a high affinity for water include one of (methylsulfinyl)methane (common name: dimethyl sulfoxide), thiolan-1,1-dione (common name: sulfolane), N,N-diemthylcarboxyamide, N,N-diethylcarboxyamide, dimethylacetamide and 1-methylpyrrolidin-2-one. These organic solvents may be contained alone or in the form of a mixture of two or more types.

The above "condensation step which causes condensation to take place on the surface of the support" refers to the step of holding the support applied with the surface layer coating solution for a fixed time in an atmosphere in which condensation takes place on the surface of the support. The condensation in this surface forming method indicates that droplets have been formed on the support applied with the surface layer coating solution through the action of water. Conditions under which the condensation takes place on the surface of the support are influenced by the relative humidity of the atmosphere in which the support is held and the evaporation conditions (e.g., vaporization heat) of the coating solution solvent. However, the surface layer coating solution contains 50% by mass or more of an aromatic organic solvent based on the total mass of the solvent in the surface layer coating solution. Hence, the conditions under which condensation occurs on the surface of the support are less influenced by the evaporation conditions of the coating solution solvent, and depend chiefly on the relative humidity of the atmosphere in which the support is held. The relative humidity at which condensation is caused to take place on the surface of the support is from 40% to 100%. The relative humidity is more desirably 70% or more. The time for the condensation step may be that necessary for the droplets to be formed by condensation. From the viewpoint of productivity, this time is desirably 1 to 300 seconds, and more desirably is approximately 10 to 180 seconds. The relative humidity is important for the condensation step, and the atmosphere desirably has a temperature of 20° C. or more and 80° C. or less.

As a result of the above drying step which heats and dries, the droplets produced on the surface by the condensation step can be formed as the depressed portions of the photosensitive member surface. In order to form the depressed portions with a high uniformity, it is important for the drying to be quick, and hence heated drying is carried out. The drying temperature in the drying step can be from 100° C. to 150° C. The time for the drying step which heats and dries may be that in which the solvent in the coating solution applied onto the support and the droplets formed by the condensation step can be removed. The time for the drying step can be 20 to 120 minutes, and more desirably is 40 to 100 minutes.

By the above method of forming the surface by causing the condensation to take place on the surface of the electrophotographic photosensitive member when its surface layer is formed, depressed portions independent from one another are formed on the surface of the photosensitive member. The method of forming the surface by causing condensation to take place on the surface of the electrophotographic photosensitive member when its surface layer is formed is a method in which droplets formed by the action of water form the depressed portions using a solvent having a low affinity for water and a binder resin. Since each shape of the depressed portions formed on the surface of the electrophotographic photosensitive member produced by this production method is formed by the cohesive force of water, the depressed portions have high uniformity. This production method goes through the step of removing droplets, or removing droplets from a state in which they have sufficiently grown. Therefore, the depressed portions of the surface of the electrophotographic photosensitive member are formed in a droplet shape or a honeycomb shape (hexagonal shape). Depressed portions in the shape of droplets are depressed portions which look, for example, circular or elliptic when the photosensitive member is observed from a top view and depressed portions which look, for example, partially circular or partially elliptic when the photosensitive member is observed from a cross section. Further, depressed portions in the shape of a honeycomb (hexagonal shape) are, for example, depressed portions formed as a result of closest packing of droplets on the surface of the electrophotographic photosensitive member. Specifically, such depressed portions look, for example, circular, hexagonal or hexagonal with round corners when the photosensitive member is observed from a top view and look, for example, partially circular or like a square column when the photosensitive member is observed from a cross section.

The method of forming the surface by the condensation on the surface of the electrophotographic photosensitive member when its surface layer is formed can produce an electrophotographic photosensitive member having a surface layer with a plurality of depressed portions which are independent from one another, where the minor axis diameter of the depressed portions is Rpc and the depth indicating the distance between the innermost part of a depressed portion and the opening surface thereof is Rdv, the depressed portions have a ratio of depth to minor axis diameter (Rdv/Rpc) of 1.0 or less. Although the depth of the depressed portions may be arbitrarily set within the above range, it is desirable to set the production conditions so that the individual depressed portions have a depth of 0.01 μm or more and 3.00 μm or less.

The above depressed portions are controllable by adjusting the production conditions within the range indicated in the above production method. The depressed portions are controllable by selecting, for example, the type of the solvent in the surface layer coating solution, the content of the solvent, the relative humidity in the condensation step, the support retention time in the condensation step, and the heating and drying temperature, which are prescribed in the present specification.

Next, the hole transporting material in the present invention will be described.

The electrophotographic photosensitive member of the present invention has a hole transporting material with an ionization potential of 4.5 eV or more and 5.3 eV or less. As a result of the synergistic effects of a hole transporting material with a low ionization potential and specific depressed portion shape, plus charge can be effectively reduced and friction memory can be suppressed. Specifically, an ionization potential of 5.3 eV or less is desirable from the standpoint of friction memory. Further, an ionization potential of 5.2 eV or less is even more desirable from the standpoint of friction memory. Although the ionization potential lower limit is not especially limited from the standpoint of friction memory, generally if the ionization potential is less than 4.5 eV, the compound is more easily oxidized. Thus, from the standpoint of electrophotographic properties, such an ionization potential is not desirable.

The ionization potential of the hole transporting material can be measured by photoelectron spectroscopy in air ("Photoelectron Spectrometer AC-2", manufactured by Riken Keiki Co., Ltd.).

Specific examples of hole transporting materials with an ionization potential of 4.5 eV or more and 5.3 eV or less which can be used in the present invention will now be illustrated. However, the present invention is not limited to these.

Formula 1

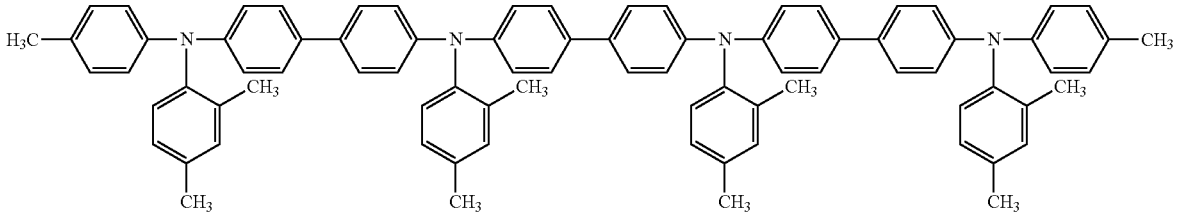

(1-1)

Formula 2

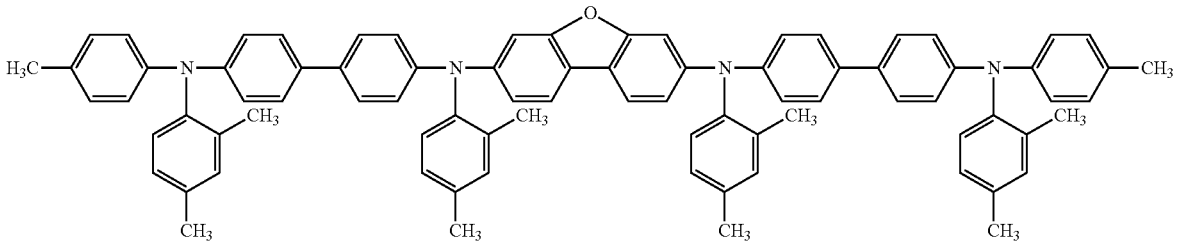

(1-2)

Formula 3

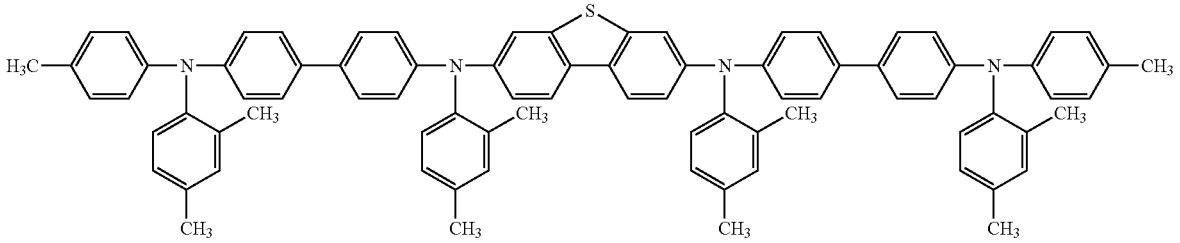

(1-3)

-continued
Formula 4
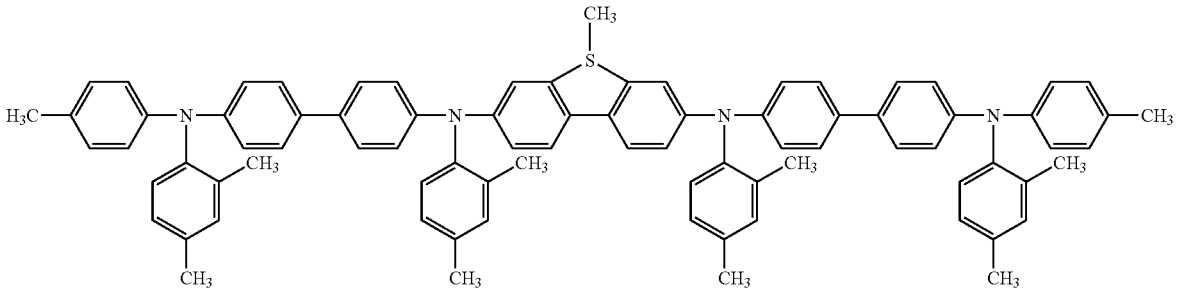
(1-4)
Formula 5
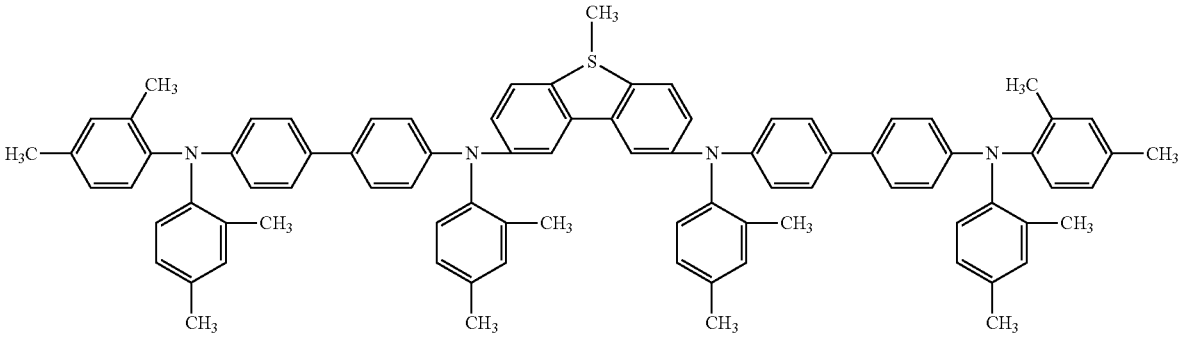
(1-5)
Formula 6
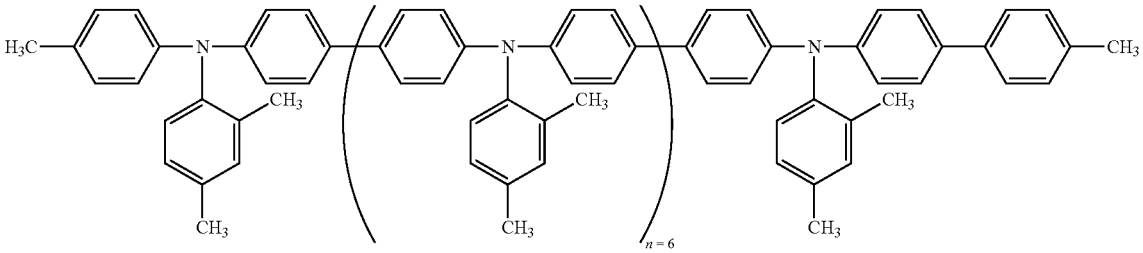
(1-6)
In formula (1-6), n denotes the average degree of polymerization.
Formula 7
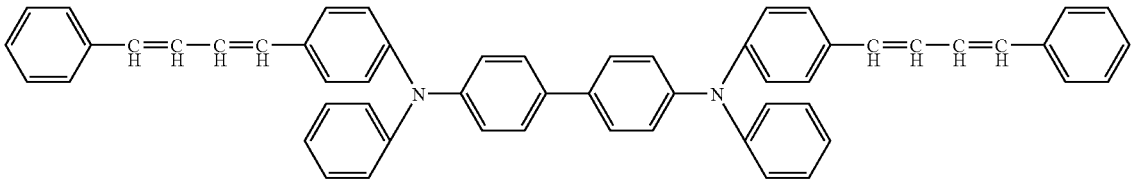
(1-7)
Formula 8
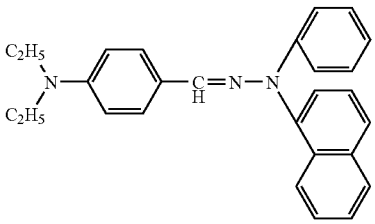
(1-8)
Formula 9
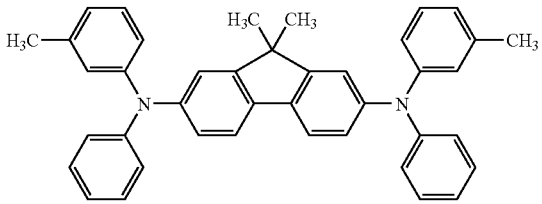
(1-9)

In the present invention, the hole transporting material with an ionization potential of 4.5 eV or more and 5.3 eV or less may be used alone or by mixing two or more types of charge transporting material. Further, a hole transporting material with an ionization potential of more than 5.3 eV may also be mixed therein in a range wherein the effects that charge can be effectively reduced and friction memory can be suppressed are not affected.

Next, the structure of the electrophotographic photosensitive member according to the present invention will be described.

The electrophotographic photosensitive member of the present invention has, as described above, a support and an organic photosensitive layer (hereinafter sometimes simply referred to as "photosensitive layer") provided on the support. The electrophotographic photosensitive member according to the present invention may commonly be a cylindrical organic electrophotographic photosensitive member in which the photosensitive layer is formed on a cylindrical support, which is in wide use, although it may also have the shape of a belt or a sheet.

The photosensitive layer can be a multi-layer type (function-separated type) photosensitive layer which is separated into a charge generating layer containing a charge generating material and a charge transporting layer containing a hole transporting material. Further, the multi-layer type photosensitive layer can be a regular-layer type photosensitive layer in which the charge generating layer and the charge transporting layer are superposed in this order from the support side. The charge generating layer may be formed in a multi-layer structure, and the charge transporting layer may also be formed in a multi-layer structure. A protective layer may further be provided on the photosensitive layer for the purpose of, for example, improving durability performance.

The support can have conductivity (be a conductive support). For example, supports made of a metal such as aluminum, aluminum alloy or stainless steel may be used. In the case of aluminum or aluminum alloy, usable are an ED pipe, an EI pipe and those obtained by subjecting these pipes to cutting, electrolytic composite polishing (electrolysis carried out using an electrode having electrolytic action and an electrolytic solution, and polishing carried out using a grinding stone having polishing action) or to wet-process or dry-process honing. Also usable are the above metal supports, or supports made of a resin (such as polyethylene terephthalate, polybutylene terephthalate, phenol resin, polypropylene or polystyrene resin), and having layers formed by vacuum deposition of aluminum, an aluminum alloy or an indium oxide-tin oxide alloy. Still also usable are supports formed of resin or paper impregnated with conductive particles such as carbon black, tin oxide particles, titanium oxide particles or silver particles, and supports made of a plastic containing a conductive binder resin.

For the purpose of preventing interference fringes caused by scattering of laser light or the like, the surface of the support may be subjected to cutting, surface roughening or aluminum anodizing.

The support desirably has, where the surface of the support is a layer provided in order to impart conductivity, a volume resistivity of that layer of $1\times10^{10}$ Ω·cm or less, and especially desirably $1\times10^{6}$ Ω·cm or less.

A conductive layer for the prevention of interference fringes caused by scattering of laser light or the like or for the covering of scratches of the support surface may be provided between the support and a below-described intermediate layer or photosensitive layer (charge generating layer or charge transporting layer). This is a layer formed by coating the support with a coating solution prepared by dispersing a conductive powder in a suitable binder resin.

Examples of such a conductive powder include: carbon black, acetylene black, metallic powders of, e.g., aluminum, nickel, iron, nichrome, copper, zinc and silver, and metal oxide powders such as conductive tin oxide and ITO.

Examples of the binder resin used simultaneously include thermoplastic resins, thermosetting resins or photocurable resins, such as polystyrene, a styrene-acrylonitrile copolymer, a styrene-butadiene copolymer, a styrene-maleic anhydride copolymer, polyester, polyvinyl chloride, a vinyl chloride-vinyl acetate copolymer, polyvinyl acetate, polyvinylidene chloride, polyarylate resins, phenoxy resins, polycarbonate, cellulose acetate resins, ethyl cellulose resins, polyvinyl butyral, polyvinyl formal, polyvinyltoluene, poly-N-vinyl carbazole, acrylic resins, silicone resins, epoxy resins, melamine resins, urethane resins, phenol resins and alkyd resins.

The conductive layer may be formed by coating a coating solution prepared by dispersing or dissolving the above conductive powder and binder resin in an ether type solvent such as tetrahydrofuran or ethylene glycol dimethyl ether, an alcohol type solvent such as methanol, a ketone type solvent such as methyl ethyl ketone, or an aromatic hydrocarbon solvent such as toluene. The conductive layer may desirably have an average layer thickness of from 0.2 μm or more and 40 μm or less, more desirably from 1 μm or more and 35 μm or less, and still more desirably from 5 μm or more and 30 μm or less.

An intermediate layer having a barrier function and an adhesion function may also be provided between the support or the conductive layer and the photosensitive layer (charge generating layer or charge transporting layer). The intermediate layer is formed for the purposes of, for example, improving the adherence of the photosensitive layer, improving coating performance, improving the injection of electric charges from the support and protecting the photosensitive layer from electrical breakdown.

The intermediate layer may be formed by coating a curable resin and then curing the resin to form a resin layer; or by coating on the conductive layer an intermediate layer coating solution containing a binder resin, and drying the resultant coating.

Examples of the binder resin of the intermediate layer include: water-soluble resins such as polyvinyl alcohol, polyvinyl methyl ether, polyacrylic acids, methyl cellulose, ethyl cellulose, polyglutamic acid and casein; and polyamide resins, polyimide resins, polyamide-imide resins, polyamic acid resins, melamine resins, epoxy resins, polyurethane resins, and polyglutamate resins. In order to bring out the electrical barrier properties effectively, and also from the viewpoint of coating properties, adherence, solvent resistance and electrical resistance, the binder resin of the intermediate layer is desirably a thermoplastic resin. Specifically, a thermoplastic polyamide resin is desirable. As the polyamide resin, a low-crystalline or non-crystalline copolymer nylon which can be applied in the state of a solution is desirable. The intermediate layer desirably has an average layer thickness of 0.05 μm or more and 7 μm or less, and more desirably 0.1 μm or more and 2 μm or less.

In the intermediate layer, semiconductive particles may be dispersed or an electron transporting material (an electron accepting material such as an acceptor) may be included in order to ensure that the flow of electric charges (carriers) does not stagnate in the intermediate layer.

Next, the photosensitive layer in the present invention will be described.

Examples of the charge generating material used in the electrophotographic photosensitive member of the present invention include: azo pigments such as monoazo, disazo and trisazo; phthalocyanine pigments such as metal phthalocyanines and metal-free phthalocyanine; indigo pigments such as indigo and thioindigo; perylene pigments such as perylene acid anhydrides and perylene acid imides; polycyclic quinone pigments such as anthraquinone and pyrenequinone; squarilium dyes, pyrylium salts and thiapyrylium salts, triphenylmethane dyes; inorganic materials such as selenium, selenium-tellurium and amorphous silicon; quinacridone pigments, azulenium salt pigments, cyanine dyes, xanthene dyes, quinoneimine dyes, and styryl dyes. The charge generating materials may be used alone or in combination with one another. Of these, particularly desirable are metal phthalocyanines such as oxytitanium phthalocyanine, hydroxygallium phthalocyanine and chlorogallium phthalocyanine, since they have a high sensitivity.

If the photosensitive layer is a multi-layer type photosensitive layer, examples of the binder resin used to form the charge generating layer include: polycarbonate resins, polyester resins, polyarylate resins, butyral resins, polystyrene resins, polyvinyl acetal resins, diallyl phthalate resins, acrylic resins, methacrylic resins, vinyl acetate resins, phenol resins, silicone resins, polysulfone resins, styrene-butadiene copolymer resins, alkyd resins, epoxy resins, urea resins, and vinyl chloride-vinyl acetate copolymer resins. In particular, butyral resins are desirable. These may be used alone or in the form of a mixture or copolymer of two or more types.

The charge generating layer may be formed by coating a charge generating layer coating solution obtained by dispersing the charge generating material in the binder resin together with a solvent, and drying the resultant coating. The charge generating layer may also be a vacuum-deposited film of the charge generating material. Examples of methods which can be used for dispersion include those using of a homogenizer, ultrasonic waves, a ball mill, a sand mill, an attritor or a roll mill. The charge generating material and the binder resin are desirably in a proportion ranging from 10:1 to 1:10 (mass ratio), and more desirably from 3:1 to 1:1 (mass ratio).

The solvent used for the charge generating layer coating solution may be selected taking account of the binder resin to be used and the solubility or dispersion stability of the charge generating material. Examples of organic solvents include alcohol type solvents, sulfoxide type solvents, ketone type solvents, ether type solvents, ester type solvents and aromatic hydrocarbon solvents.

The charge generating layer desirably has an average layer thickness of 5 μm or less, and more desirably from 0.1 μm to 2 μm.

The charge generating layer may optionally contain various sensitizers, antioxidants, ultraviolet absorbers and/or a plasticizer. An electron transporting material (an electron accepting material such as an acceptor) may also be included in the charge generating layer in order to ensure that the flow of electric charges (carriers) does not stagnate in the charge generating layer.

The hole transporting material used in the electrophotographic photosensitive member of the present invention has an ionization potential of 4.5 eV or more and 5.3 eV or less. Examples thereof include triarylamine compounds, hydrazone compounds, styryl compounds, stilbene compounds, pyrazoline compounds, oxazole compounds, thiazole compounds, and triarylmethane compounds. A single type alone or two or more types of these hole transporting materials may be used.

The charge transporting layer may be formed by coating a charge transporting layer coating solution prepared by dissolving the hole transporting material and a binder resin in a solvent, and drying the resultant coating. Further, of the above hole transporting materials, a hole transporting material which by itself has film forming properties may be used alone to form the charge transporting layer without the use of any binder resin.

If the photosensitive layer is a multi-layer type photosensitive layer, examples of the binder resin used to form the charge transporting layer include: acrylic resins, styrene resins, polyester resins, polycarbonate resins, polyarylate resins, polysulfone resins, polyphenylene oxide resins, epoxy resins, polyurethane resins, alkyd resins and unsaturated resins. In particular, polymethyl methacrylate resins, polystyrene resins, styrene-acrylonitrile copolymer resins, polycarbonate resins, polyarylate resins and diallyl phthalate resins are desirable. These may be used alone or in the form of a mixture or copolymer of two or more types.

The charge transporting layer may be formed by coating a charge transporting layer coating solution obtained by dissolving the hole transporting material and binder resin in a solvent, and drying the resultant coating. The hole transporting material and the binder resin are desirably in a proportion ranging from 2:1 to 1:2 (mass ratio).

Examples of the solvent used in the charge transporting layer coating solution include the following: ketone type solvents such as acetone and methyl ethyl ketone; ester type solvents such as methyl acetate and ethyl acetate; ether type solvents such as tetrahydrofuran, dioxolane, dimethoxymethane and dimethoxyethane; and aromatic hydrocarbon solvents such as toluene, xylene and chlorobenzene. These solvents may be used alone, or may be used in the form of a mixture of two or more types. Of these solvents, from the viewpoint of resin solubility, it is desirable to use ether type solvents or aromatic hydrocarbon solvents.

The charge transporting layer desirably has an average layer thickness of from 5 μm to 50 μm, and more desirably from 10 μm to 35 μm.

An antioxidant, an ultraviolet absorber and/or a plasticizer for example may also optionally be added to the charge transporting layer.

Various additives may be added to the respective layers of the electrophotographic photosensitive member of the present invention. Examples of such additives include deterioration preventives such as an antioxidant and an ultraviolet absorber, and lubricants such as fluorine-atom-containing resins and the like.

The electrophotographic photosensitive member of the present invention has, as described above, specific depressed portions on the surface of the electrophotographic photosensitive member. The depressed portions in the present invention act effectively when applied to photosensitive members having a specific hole transporting material.

Figure 9:
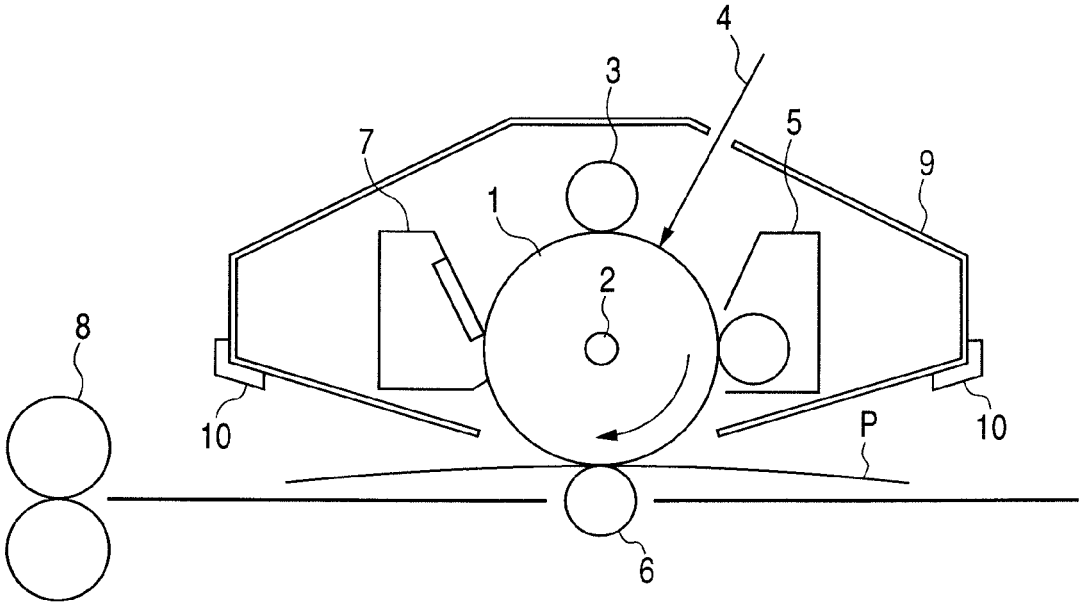
FIG. 9 is a schematic view illustrating an example of the structure of an electrophotographic apparatus provided with a process cartridge having the electrophotographic photosensitive member according to the present invention.

Next, the process cartridge and electrophotographic apparatus according to the present invention will be described. FIG. 9 is a schematic view illustrating an example of the structure of an electrophotographic apparatus provided with a process cartridge having the electrophotographic photosensitive member of the present invention.

In FIG. 9, a cylindrical electrophotographic photosensitive member 1 is rotatingly driven around an axis 2 in the direction of the arrow at a certain peripheral speed.

The surface of the electrophotographic photosensitive member 1 rotatingly driven is uniformly electrostatically charged to a positive or negative given potential by a charging device (primary charging device, such as a charging roller) 3. The surface of the electrophotographic photosensitive member is then exposed to exposure light (image exposure light) 4 emitted from an exposure device (not shown) for slit exposure, laser beam scanning exposure or the like. In this way, electrostatic latent images corresponding to the intended image are successively formed on the surface of the electrophotographic photosensitive member 1.

The electrostatic latent images formed on the surface of the electrophotographic photosensitive member 1 are developed with a toner contained in a developer of a developing device 5, to form toner images. Then, the toner images formed and held on the surface of the electrophotographic photosensitive member 1 are successively transferred by a transfer bias from a transfer device (such as a transfer roller) 6 onto a transfer material (such as paper) P fed from a transfer material feed device (not shown) to a part (abutting portion) between the electrophotographic photosensitive member 1 and the transfer device 6. The transfer material is fed in synchronization with the rotation of the electrophotographic photosensitive member 1.

The transfer material P to which the toner images have been transferred is separated from the surface of the electrophotographic photosensitive member 1 and led to a fixing device 8, where the toner images are fixed, and is then printed out of the apparatus as an image-formed material (a print or a copy).

The developer (toner) remaining after the transfer is removed from the surface of the electrophotographic photosensitive member 1 from which the toner images have been transferred with a cleaning device (such as a cleaning blade) 7 so that the surface is cleaned. The surface of the electrophotographic photosensitive member 1 is further subjected to charge elimination by pre-exposure light (not shown) emitted from a pre-exposure device (not shown), and is then again used for the formation of images. It is noted that if, as illustrated in FIG. 9, the charging device 3 is a contact charging device employing, for example, a charging roller, the pre-exposure is not necessarily required.

The apparatus may be constituted of a combination of plural components integrally joined in a container as a process cartridge from among the constituents such as the above electrophotographic photosensitive member 1, charging device 3, developing device 5 and cleaning device 7. This process cartridge may also be set up so as to be freely detachable/mountable to the main body of an electrophotographic apparatus such as a copying machine or a laser beam printer. In FIG. 9, the electrophotographic photosensitive member 1, and the charging device 3, developing device 5 and cleaning device 7 are integrally supported to form a cartridge so as to form a process cartridge 9 that is freely detachable/mountable to the main body of the electrophotographic apparatus through a guiding device 10 such as rails in the main body of the electrophotographic apparatus.

EXAMPLES

The present invention will now be described in more detail by giving specific examples. In the following examples, the term "part(s)" means "part(s) by mass".

Example 1

An aluminum cylinder 30 mm in diameter and 260.5 mm in length which had been subjected to surface cutting processing was used as a support (cylindrical support).

Next, a solution containing the following components was dispersed for about 20 hours with a ball mill to prepare a conductive layer coating solution.

| | |
|---|---|
| Powder containing barium sulfate particles having a coating layer of tin oxide (trade name: "Pastran PC1"; manufactured by Mitsui Mining & Smelting Co., Ltd.) | 60 parts |
| Titanium oxide (trade name: "Titanix JR"; manufactured by Tayca Corporation) | 15 parts |
| Resol type phenolic resin (trade name: "Phenolite J-325"; manufactured by DIC Corporation Co., Ltd.; solid content: 70%) | 43 parts |
| Silicone oil (trade name: "SH28PA"; manufactured by Toray-Dow Corning Silicone Co., Ltd.) | 0.015 parts |
| Silicone resin (trade name: "Tospearl 120"; manufactured by Toshiba Silicone Co., Ltd.) | 3.6 parts |
| 2-Methoxy-1-propanol | 50 parts |
| Methanol | 50 parts |

The thus-prepared conductive layer coating solution was applied on the above support by dip coating, and then heat cured for 1 hour in an oven heated to 140° C., to form a conductive layer with an average layer thickness of 15 μm at a position 170 mm from the support upper end.

Next, an intermediate layer coating solution prepared by dissolving the following components in a mixed solution of 400 parts of methanol and 200 parts of n-butanol was applied on the conductive layer by dip coating. Heat drying was then carried out for 30 minutes in an oven heated to 100° C., to form an intermediate layer with an average layer thickness of 0.45 μm at a position 170 mm from the support upper end.

| | |
|---|---|
| Copolymer nylon resin (trade name: "Amilan CM8000"; manufactured by Toray Industries, Inc.) | 10 parts |
| Methoxymethylated nylon 6 resin (trade name: "Toresin EF-30T"; manufactured by Nagase ChemteX Corporation) | 30 parts |

Next, the following components were dispersed for 4 hours with a sand mill using glass beads 1 mm in diameter, and then 700 parts of ethyl acetate was added to prepare a charge generating layer coating solution.

| | |
|---|---|
| Hydroxygallium phthalocyanine (having strong peaks at 7.5°, 9.9°, 16.3°, 18.6°, 25.1° and 28.30 (Bragg angles of 2θ ± 0.2°) in CuKα characteristics X-ray diffraction) | 20 parts |
| The calixarene compound represented by the following structural formula (2) | 0.2 parts |

(2)

-continued

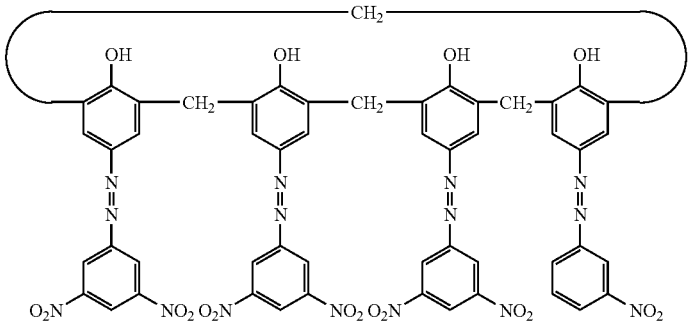

| | |
|---|---|
| Polyvinyl butyral (trade name: "S-LEC BX-1", manufactured by Sekisui Chemical Co., Ltd.) | 10 parts |
| Cyclohexanone | 600 parts |

The above charge generating layer coating solution was applied on the intermediate layer by dip coating. Heat drying was then carried out for 15 minutes in an oven heated to 80° C., to form a charge generating layer with an average layer thickness of 0.17 μm at a position 170 mm from the support upper end.

Next, the following components were dissolved in a mixed solvent of 600 parts of chlorobenzene and 200 parts of methylal to prepare a charge transporting layer coating solution. Using this solution, a charge transporting layer was applied on the charge generating layer by dip coating. Heat drying was then carried out for 30 minutes in an oven heated to 110° C., to form a charge transporting layer with an average layer thickness of 20 μm at a position 170 mm from the support upper end.

| | |
|---|---|
| Hole transporting material represented by the following structural formula (1-5) | 50 parts |

(1-5)

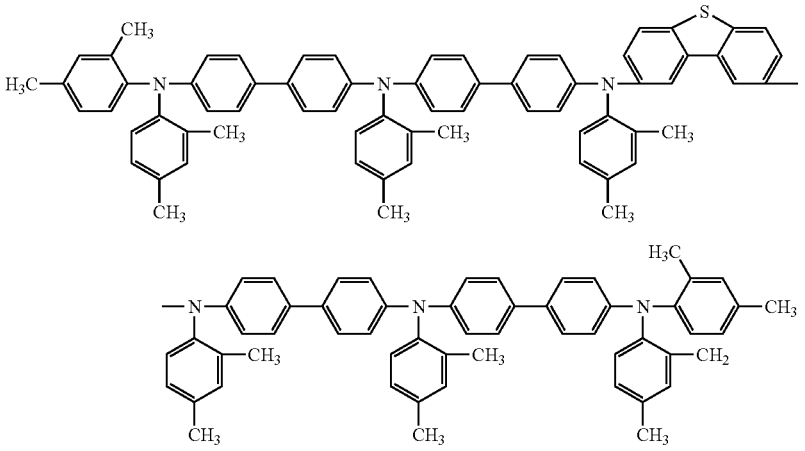

| | |
|---|---|
| Polycarbonate resin (trade name: "Iupilon Z400"; manufactured by Mitsubishi Engineering-Plastics Corporation) | 100 parts |

Figure 10:
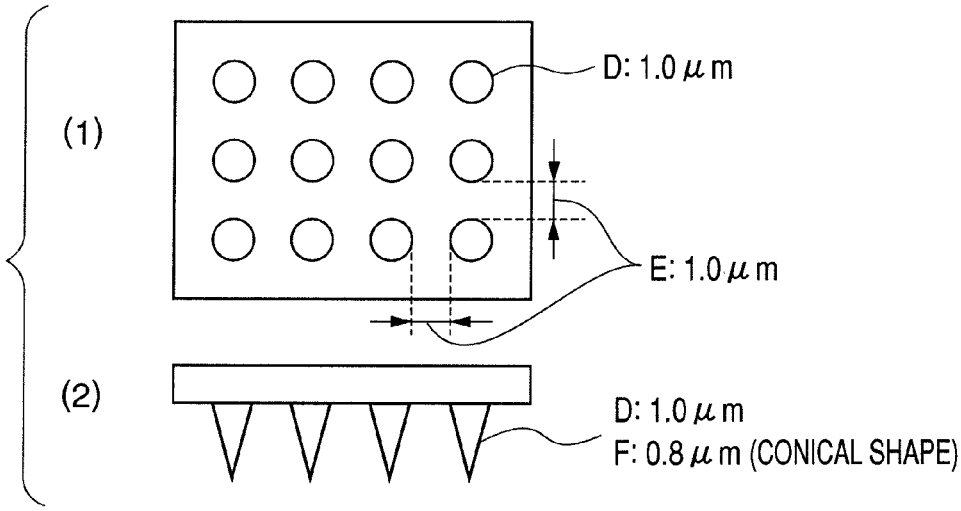
FIG. 10 is a view illustrating the profile of the mold (partial enlarged view) used in Example 1.

The electrophotographic photosensitive member produced in the manner described above was set in the apparatus illustrated in FIG. 7 and subjected to surface processing using the mold for surface profile transfer illustrated in FIG. 10. The temperatures of the electrophotographic photosensitive member and the mold at the time of the surface processing was controlled at 110° C., and the electrophotographic photosensitive member was rotated in its peripheral direction while applying a pressure of 50 kg/cm$^2$ to perform surface profile transfer. In FIG. 10, (1) is a view of the mold profile as seen from above, and (2) is a view of the mold profile as seen from the side.

<Measurement of the Surface Profile of the Electrophotographic Photosensitive Member>

The surface of the electrophotographic photosensitive member produced in the manner described above was observed with an ultradepth profile measuring microscope VK-9500 (manufactured by Keyence Corporation). The measuring object electrophotographic photosensitive member was placed on a stand which had been worked so that a cylindrical support could be fastened, and the surface of the electrophotographic photosensitive member was observed at a position 170 mm distant from its upper end. Here, the objective lens was set at 50-times magnification under observation in a 100 μm×100 μm visual field. The depressed portions observed in the visual field of measurement were analyzed using an analytical program.

Figure 11:
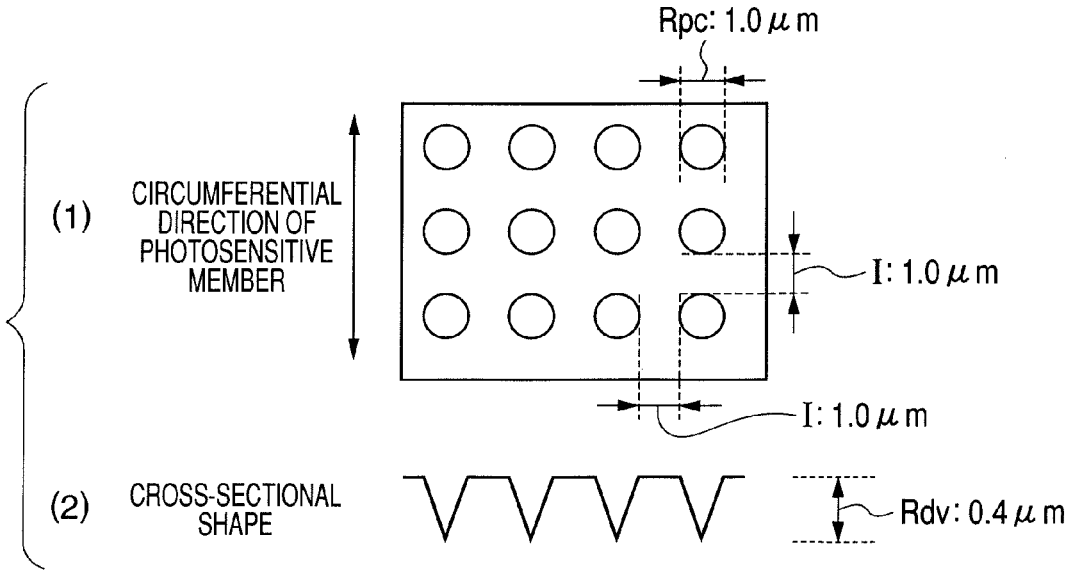
FIG. 11 is a view illustrating the array pattern of the depressed portions (partial enlarged view) of the photosensitive member outermost surface obtained from Example 1.

The shape, minor axis diameter (Rpc) and depth (Rdv), which indicates the distance between the innermost part of a depressed portion and the opening surface thereof, of the surface portion of the depressed portions in the visual field of measurement, were measured. It was confirmed that the conical depressed portions illustrated in FIG. 11 were formed on the surface of the electrophotographic photosensitive member. The number of depressed portions per 100 μm square, specifically per unit area (100 μm×100 μm), having a ratio of depth to minor axis diameter (Rdv/Rpc) of 1.0 or less, was calculated to be 2,500. Further, the minor axis diameter Rpc of the surface portion of the depressed portions was 1.0 μm. Further, the average distance between depressed portions closest to each other (hereinafter referred to as "depressed portion interval (I)") was 1.0 μm. The depth Rdv of the depressed portions was 0.4 μm. The area ratio was also calculated to be 20%. The results are shown in Table 1. (In Table 1, "Number" shows the number of depressed portions per 100 μm square, specifically per unit area (100 μm×100 μm), having a ratio of depth to minor axis diameter (Rdv/Rpc) of 1.0 or less. "Rpc" indicates the average minor axis diameter of the depressed portions per 100 μm square, specifically per unit area (100 μm×100 μm) "Rdv" indicates the average depth of the depressed portions per 100 μm square, specifically per unit area (100 μm×100 μm) "Rdv/Rpc" indicates the ratio of average depth to average minor axis diameter of the depressed portions per 100 μm square, specifically per unit area (100 μm×100 μm)).

<Ionization Potential Measurement of the Hole Transporting Material>

The ionization potential of the electrophotographic photosensitive member produced in the manner described above was measured. Measurement was carried out by photoelectron spectroscopy in air ("Photoelectron Spectrometer AC-2", manufactured by Riken Keiki Co., Ltd.). In the measurement, the irradiated energy range was set to 4.2 eV to 6.2 eV, and ionization potential was calculated from the intersection of the baseline of a standardized light quantum ratio and the start-up line (linear approximation).

<Friction Memory Properties of the Electrophotographic Photosensitive Member>

The electrophotographic photosensitive member produced in the manner described above was placed on a Hewlett-Packard LaserJet 4250 laser beam printer having a modified process cartridge, and then evaluated according to the following vibration test. The modification increased the spring pressure of the charge member by 1.5 times.

The vibration test was carried out at 15° C. under a 10% RH environment according to a physical test standard (JIS Z0230). The process cartridge was set in a vibration test apparatus (EMIC Corp. Model 905-FN), and the vibration test was carried out in the x, y and z respective directions at a frequency of 10 to 100 Hz, an acceleration of 1 G, a sweep direction Lin Sweep and a 5 minute round-trip sweep time for a test time of 1 hour. After leaving for 2 hours, a half-tone image was output using the above-described printer and evaluated. Image evaluated was carried out visually. Products on which no memory occurred were evaluated with an "A", products on which slight memory occurred were evaluated with a "B", products on which memory had occurred were evaluated with a "C" and products on which memory had clearly occurred were evaluated with a "D". The results are shown in Table 1.

<Evaluation of Plus Charge Decretion Properties of the Electrophotographic Photosensitive Member>

The electrophotographic photosensitive member produced in the manner described above was placed on the above-described Hewlett-Packard LaserJet 4250 laser beam printer having a modified process cartridge, and then evaluated in the following manner. The evaluated was carried out at 15° C. under a 10% RH environment. The charging roller of a cartridge was fixed so that it could not be driven with a drum, and that cartridge was mounted in a printer. In a state wherein charging and exposure were not carried out, the photosensitive member was rotatingly driven until it reached a charge of plus 50 V, after which the rotating driving was stopped. The decrement in the plus charge after being left for 1 minute was measured to measure the plus charge decrement ratio. The plus charge decrement ratio was calculated using the following formula. However, for products which did not reach 50 V even after being rotatingly driven for 5 minutes, the rotating driving was stopped after 5 minutes, and the subsequent plus charge decrement ratio was measured. The results are shown in Table 1.

$$\text{Plus charge decrement ratio} = \text{plus decrement amount} / \text{plus charge amount} \times 100\%$$

Example 2

An electrophotographic photosensitive member was produced in the same manner as in Example 1. Next, the surface of the electrophotographic photosensitive member was subjected to the same processing as in Example 1, except that, in the mold used for Example 1, the minor axis diameter indicated by D in FIG. 10 was changed from 1.0 μm to 0.5 μm, the interval indicated by E in FIG. 10 was changed from 1.0 μm to 0.5 μm, and the height indicated by F in FIG. 10 was changed from 0.8 μm to 0.4 μm. It was confirmed by measuring the surface profile in the same manner as in Example 1 that conical depressed portions were formed. The measurement results are shown in Table 1. Further, the depressed portions were formed at 0.5 μm intervals, and the area ratio was calculated to be 20%. The properties of the electrophotographic photosensitive member were evaluated in the same manner as in Example 1. The results are shown in Table 1.

Example 3

An electrophotographic photosensitive member was produced in the same manner as in Example 1. Next, the surface of the electrophotographic photosensitive member was subjected to the same processing as in Example 1, except that, in the mold used for Example 1, the minor axis diameter indicated by D in FIG. 10 was changed from 1.0 μm to 0.2 μm, the interval indicated by E in FIG. 10 was changed from 1.0 μm to 0.2 μm, and the height indicated by F in FIG. 10 was changed from 0.8 μm to 0.16 μm. It was confirmed by measuring the surface profile in the same manner as in Example 1 that conical depressed portions were formed. The measurement results are shown in Table 1. Further, the depressed portions were formed at 0.2 μm intervals, and the area ratio was calculated to be 20%. The properties of the electrophotographic photosensitive member were evaluated in the same manner as in Example 1. The results are shown in Table 1.

Example 4

An electrophotographic photosensitive member was produced in the same manner as in Example 1. Next, the surface of the electrophotographic photosensitive member was subjected to the same processing as in Example 1, except that, in the mold used for Example 1, the minor axis diameter indicated by D in FIG. 10 was changed from 1.0 μm to 0.1 μm, the interval indicated by E in FIG. 10 was changed from 1.0 μm to 0.1 μm, and the height indicated by F in FIG. 10 was changed from 0.8 μm to 0.08 μm. It was confirmed by measuring the surface profile in the same manner as in Example 1 that conical depressed portions were formed. The measurement results are shown in Table 1. Further, the depressed portions were formed at 0.1 μm intervals, and the area ratio was calculated to be 20%. The properties of the electrophotographic photosensitive member were evaluated in the same manner as in Example 1. The results are shown in Table 1.

Example 5

An electrophotographic photosensitive member was produced in the same manner as in Example 1. Next, the surface of the electrophotographic photosensitive member was subjected to the same processing as in Example 1, except that, in the mold used for Example 1, the minor axis diameter indicated by D in FIG. 10 was changed from 1.0 μm to 0.05 μm, the interval indicated by E in FIG. 10 was changed from 1.0 μm to 0.05 μm, and the height indicated by F in FIG. 10 was changed from 0.8 μm to 0.04 μm. It was confirmed by measuring the surface profile in the same manner as in Example 1 that conical depressed portions were formed. The measurement results are shown in Table 1. Further, the depressed portions were formed at 0.05 μm intervals, and the area ratio was calculated to be 20%. The properties of the electrophotographic photosensitive member were evaluated in the same manner as in Example 1. The results are shown in Table 1.

Example 6

An electrophotographic photosensitive member was produced in the same manner as in Example 1. Next, the surface of the electrophotographic photosensitive member was subjected to the same processing as in Example 1, except that, in the mold used for Example 1, the minor axis diameter indicated by D in FIG. 10 was changed from 1.0 μm to 2.0 μm, the interval indicated by E in FIG. 10 was changed from 1.0 μm to 2.0 μm, and the height indicated by F in FIG. 10 was changed from 0.8 μm to 1.6 μm. It was confirmed by measuring the surface profile in the same manner as in Example 1 that conical depressed portions were formed. The measurement results are shown in Table 1. Further, the depressed portions were formed at 2.0 μm intervals, and the area ratio was calculated to be 20%. The properties of the electrophotographic photosensitive member were evaluated in the same manner as in Example 1. The results are shown in Table 1.

Example 7

An electrophotographic photosensitive member was produced in the same manner as in Example 1. Next, the surface of the electrophotographic photosensitive member was subjected to the same processing as in Example 1, except that, in the mold used for Example 1, the minor axis diameter indicated by D in FIG. 10 was changed from 1.0 μm to 3.0 μm, the interval indicated by E in FIG. 10 was changed from 1.0 μm to 3.0 μm, and the height indicated by F in FIG. 10 was changed from 0.8 μm to 2.4 μm. It was confirmed by measuring the surface profile in the same manner as in Example 1 that conical depressed portions were formed. The measurement results are shown in Table 1. Further, the depressed portions were formed at 3.0 μm intervals, and the area ratio was calculated to be 20%. The properties of the electrophotographic photosensitive member were evaluated in the same manner as in Example 1. The results are shown in Table 1.

Example 8

An electrophotographic photosensitive member was produced in the same manner as in Example 1. Next, the surface of the electrophotographic photosensitive member was subjected to the same processing as in Example 1, except that, in the mold used for Example 1, the minor axis diameter indicated by D in FIG. 10 was changed from 1.0 μm to 3.0 μm, the interval indicated by E in FIG. 10 was changed from 1.0 μm to 3.0 μm, and the height indicated by F in FIG. 10 was changed from 0.8 μm to 6.0 μm. It was confirmed by measuring the surface profile in the same manner as in Example 1 that conical depressed portions were formed. The measurement results are shown in Table 1. Further, the depressed portions were formed at 3.0 μm intervals, and the area ratio was calculated to be 20%. The properties of the electrophotographic photosensitive member were evaluated in the same manner as in Example 1. The results are shown in Table 1.

Example 9

An electrophotographic photosensitive member was produced in the same manner as in Example 1. Next, the surface of the electrophotographic photosensitive member was subjected to the same processing as in Example 1, except that, in the mold used for Example 1, the minor axis diameter indicated by D in FIG. 10 was changed from 1.0 μm to 0.5 μm and the interval indicated by E in FIG. 10 was changed from 1.0 μm to 0.5 μm. It was confirmed by measuring the surface profile in the same manner as in Example 1 that conical depressed portions were formed. The measurement results are shown in Table 1. Further, the depressed portions were formed at 0.5 μm intervals, and the area ratio was calculated to be 20%. The properties of the electrophotographic photosensitive member were evaluated in the same manner as in Example 1. The results are shown in Table 1.

Example 10

An electrophotographic photosensitive member was produced in the same manner as in Example 1. Next, the surface of the electrophotographic photosensitive member was subjected to the same processing as in Example 1, except that, in the mold used for Example 1, the minor axis diameter indicated by D in FIG. 10 was changed from 1.0 μm to 0.5 μm, the interval indicated by E in FIG. 10 was changed from 1.0 μm to 0.5 μm, and the height indicated by F in FIG. 10 was changed from 0.8 μm to 0.2 μm. It was confirmed by measuring the surface profile in the same manner as in Example 1 that conical depressed portions were formed. The measurement results are shown in Table 1. Further, the depressed portions were formed at 0.5 μm intervals, and the area ratio was calculated to be 20%. The properties of the electrophotographic photosensitive member were evaluated in the same manner as in Example 1. The results are shown in Table 1.

Example 11

An electrophotographic photosensitive member was produced in the same manner as in Example 1. Next, the surface of the electrophotographic photosensitive member was subjected to the same processing as in Example 1, except that, in the mold used for Example 1, the minor axis diameter indicated by D in FIG. 10 was changed from 1.0 μm to 0.5 μm, the interval indicated by E in FIG. 10 was changed from 1.0 μm to 0.5 μm, and the height indicated by F in FIG. 10 was changed from 0.8 μm to 0.1 μm. It was confirmed by measuring the surface profile in the same manner as in Example 1 that conical depressed portions were formed. The measurement results are shown in Table 1. Further, the depressed portions were formed at 0.5 μm intervals, and the area ratio was calculated to be 20%. The properties of the electrophotographic photosensitive member were evaluated in the same manner as in Example 1. The results are shown in Table 1.

Example 12

An electrophotographic photosensitive member was produced in the same manner as in Example 1. Next, the surface of the electrophotographic photosensitive member was subjected to the same processing as in Example 1, except that, in the mold used for Example 1, the minor axis diameter indicated by D in FIG. 10 was changed from 1.0 μm to 0.5 μm, the interval indicated by E in FIG. 10 was changed from 1.0 μm to 0.6 μm, and the height indicated by F in FIG. 10 was changed from 0.8 μm to 0.4 μm. It was confirmed by measuring the surface profile in the same manner as in Example 1 that conical depressed portions were formed. The measurement results are shown in Table 1. Further, the depressed portions were formed at 0.6 μm intervals, and the area ratio was calculated to be 16%. The properties of the electrophotographic photosensitive member were evaluated in the same manner as in Example 1. The results are shown in Table 1.

Example 13

An electrophotographic photosensitive member was produced in the same manner as in Example 1. Next, the surface of the electrophotographic photosensitive member was subjected to the same processing as in Example 1, except that, in the mold used for Example 1, the minor axis diameter indicated by D in FIG. 10 was changed from 1.0 μm to 0.5 μm, the interval indicated by E in FIG. 10 was changed from 1.0 μm to 0.3 μm, and the height indicated by F in FIG. 10 was changed from 0.8 μm to 0.4 μm. It was confirmed by measuring the surface profile in the same manner as in Example 1 that conical depressed portions were formed. The measurement results are shown in Table 1. Further, the depressed portions were formed at 0.3 μm intervals, and the area ratio was calculated to be 31%. The properties of the electrophotographic photosensitive member were evaluated in the same manner as in Example 1. The results are shown in Table 1.

Example 14

Figure 12:
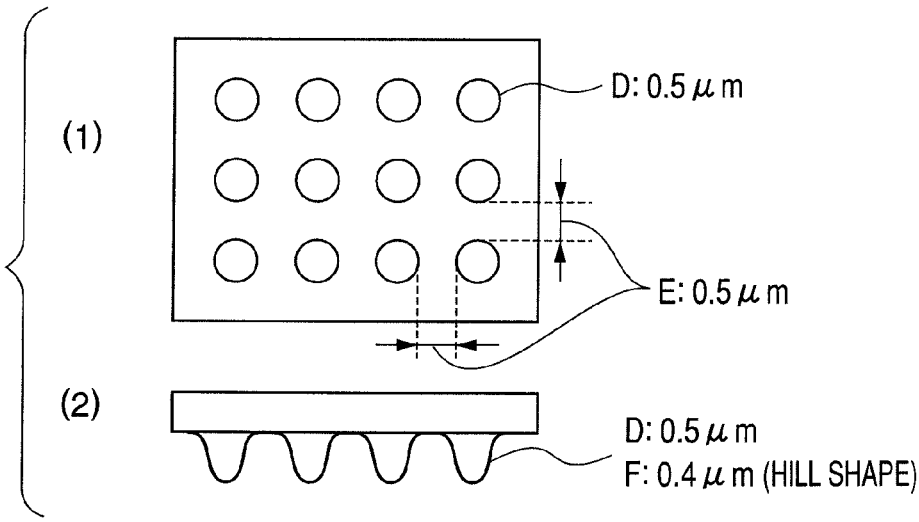
FIG. 12 is a view illustrating the profile of the mold (partial enlarged view) used in Example 14.
Figure 13:
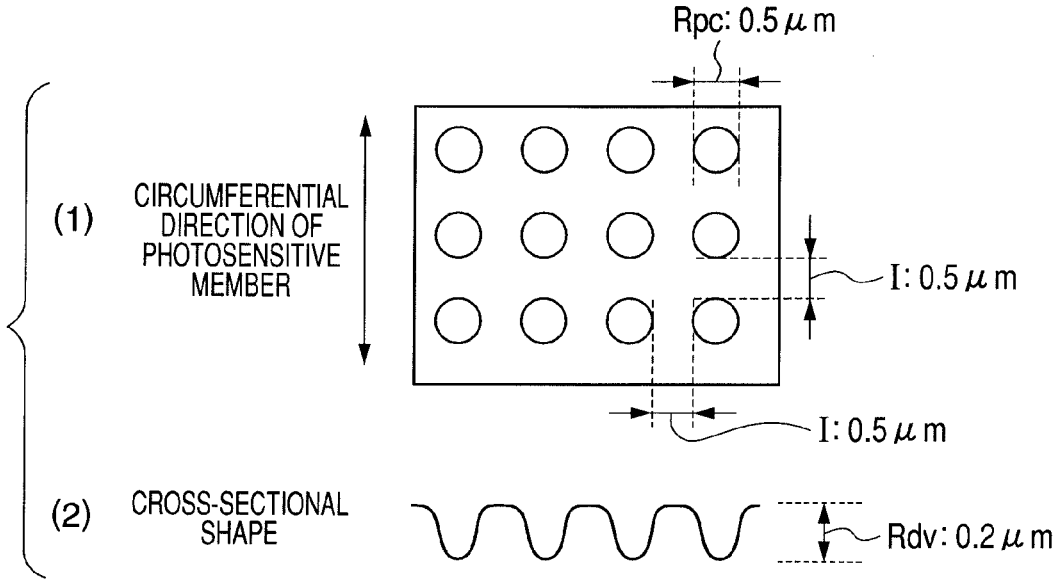
FIG. 13 is a view illustrating the array pattern of the depressed portions (partial enlarged view) of the photosensitive member outermost surface obtained from Example 14.

An electrophotographic photosensitive member was produced in the same manner as in Example 1. Next, the surface of the electrophotographic photosensitive member was subjected to the same processing as in Example 1, except that the mold used for Example 1 was changed to the hill-shaped mold illustrated in FIG. 12. In FIG. 12, (1) is a view as seen from the top of the mold profile, and (2) is a view as seen from the side of the mold profile. It was confirmed by measuring the surface profile in the same manner as in Example 1 that the hilly depressed portions illustrated in FIG. 13 were formed. The measurement results are shown in Table 1. Further, the depressed portion interval (I) was formed at an interval of 0.5 μm, and the area ratio was calculated to be 20%. The properties of the electrophotographic photosensitive member were evaluated in the same manner as in Example 1. The results are shown in Table 1.

Example 15

Figure 14:
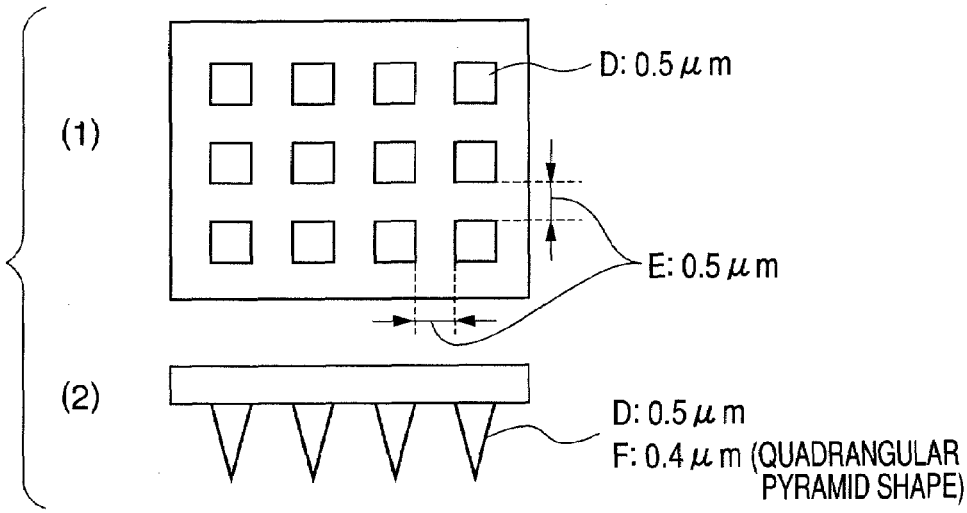
FIG. 14 is a view illustrating the profile of the mold (partial enlarged view) used in Example 15.
Figure 15:
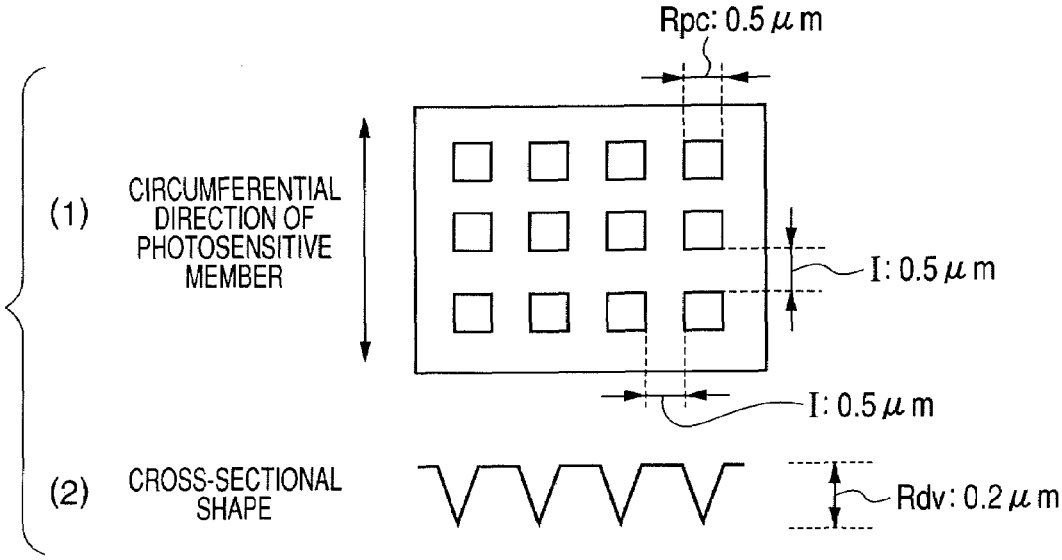
FIG. 15 is a view illustrating the array pattern of the depressed portions (partial enlarged view) of the photosensitive member outermost surface obtained from Example 15.

An electrophotographic photosensitive member was produced in the same manner as in Example 1. Next, the surface of the electrophotographic photosensitive member was subjected to the same processing as in Example 1, except that the mold used for Example 1 was changed to the quadrangular pyramid-shaped mold illustrated in FIG. 14. In FIG. 14, (1) is a view as seen from the top of the mold shape, and (2) is a view as seen from the side of the mold shape. It was confirmed by measuring the surface profile in the same manner as in Example 1 that the quadrangular pyramid-shaped depressed portion illustrated in FIG. 15 was formed. The measurement results are shown in Table 1. Further, the depressed portion interval (I) was formed in 0.5 μm intervals, and the area ratio was calculated to be 25%. The properties of the electrophotographic photosensitive member were evaluated in the same manner as in Example 1. The results are shown in Table 1.

Example 16

An electrophotographic photosensitive member was produced in the same manner as in Example 1, except that the hole transporting material of Example 1 was changed to that of Formula (1-9). Next, using the mold used in Example 3, the surface of the electrophotographic photosensitive member was subjected to the same processing as in Example 3. It was confirmed by measuring the surface profile in the same manner as in Example 1 that needle-shaped depressed portions were formed. The measurement results are shown in Table 1. Further, the depressed portions were formed at 0.5 μm intervals, and the area ratio was calculated to be 20%. The properties of the electrophotographic photosensitive member were evaluated in the same manner as in Example 1. The results are shown in Table 1.

Example 17

An electrophotographic photosensitive member was produced in the same manner as in Example 1, except that the hole transporting material of Example 1 was changed to that of Formula (1-2). Next, using the mold used in Example 3, the surface of the electrophotographic photosensitive member was subjected to the same processing as in Example 3. It was confirmed by measuring the surface profile in the same manner as in Example 1 that needle-shaped depressed portions were formed. The measurement results are shown in Table 1. Further, the depressed portions were formed at 0.5 μm intervals, and the area ratio was calculated to be 20%. The properties of the electrophotographic photosensitive member were evaluated in the same manner as in Example 1. The results are shown in Table 1.

Example 18

An electrophotographic photosensitive member was produced in the same manner as in Example 1. Next, the surface of the electrophotographic photosensitive member was subjected to the same processing as in Example 1, except that, in the mold used for Example 1, the minor axis diameter indicated by D in FIG. 10 was changed from 1.0 μm to 3.0 μm, the interval indicated by E in FIG. 10 was changed from 1.0 μm to 7.0 μm, and the height indicated by F in FIG. 10 was changed from 0.8 μm to 2.4 μm. It was confirmed by measuring the surface profile in the same manner as in Example 1 that conical depressed portions were formed. The measurement results are shown in Table 1. Further, the depressed portions were formed at 7.0 μm intervals, and the area ratio was calculated to be 4%. The properties of the electrophotographic photosensitive member were evaluated in the same manner as in Example 1. The results are shown in Table 1.

Example 19

A conductive layer, an intermediate layer and a charge generating layer were formed on a support in the same manner as in Example 1.

Next, the below-described components were dissolved in a mixed solvent of 600 parts of chlorobenzene and 200 parts of methylal to prepare a charge transporting layer coating solution. Using this solution, a charge transporting layer was applied on the charge generating layer by dip coating. Heat drying was then carried out for 30 minutes in an oven heated to 110° C., to form a charge transporting layer with an average layer thickness of 20 μm at a position 170 mm from the support upper end.

| | |
|---|---|
| Hole transporting material represented by the above formula (1-5) | 50 parts |
| Polyarylate resin represented by the following structural formula (3) | 100 parts |

(3)

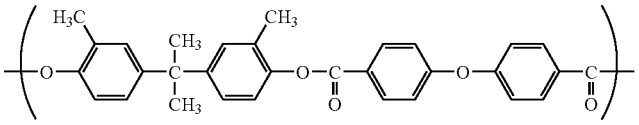

The weight average molecular weight (Mw) of this polyarylate resin is 130,000.

In the present invention, the weight average molecular weight of the resin was measured in the following way by a conventional method.

Specifically, a measuring target resin was put in tetrahydrofuran, and left to stand for several hours. Then, while shaking, the measuring target resin was well mixed with the tetrahydrofuran (mixed until coalescent matter of the measuring target resin disappeared). The resultant solution was left to stand for a further 12 hours or more.

Thereafter, the solution was passed through a sample-treating filter Maishoridisk H-25-5 manufactured by Tosoh Corporation, and the resultant product was used as a sample for GPC (gel permeation chromatography).

Next, a column was stabilized in a 40° C. heat chamber. Tetrahydrofuran was flowed through the column at this temperature at a flow rate of 1 mL per minute, and 10 μL of the sample for GPC was injected to measure the weight average molecular weight of the measuring target resin. As the column, a TSKgel SuperHM-M manufactured by Tosoh Corporation was used.

In measuring the weight average molecular weight of the measuring target resin, the molecular weight distribution of the measuring target resin was calculated from the relationship between the logarithmic value of a calibration curve prepared using several kinds of monodisperse polystyrene standard samples and the count number. As the standard polystyrene samples for preparing the calibration curve, used were 10 monodisperse polystyrene samples with molecular weights of 3,500, 12,000, 40,000, 75,000, 98,000, 120,000, 240,000, 500,000, 800,000 and 1,800,000 manufactured by Sigma-Aldrich Corporation. An RI (refractive index) detector was used as the detector.

The surface of the thus-produced electrophotographic photosensitive member was subjected to the same processing as in Example 1. It was confirmed by measuring the surface profile in the same manner as in Example 1 that conical depressed portions were formed. The measurement results are shown in Table 1. Further, the depressed portions were formed at 1.0 μm intervals, and the area ratio was calculated to be 20%. The properties of the electrophotographic photosensitive member were evaluated in the same manner as in Example 1. The results are shown in Table 1.

Examples 20 to 36

Electrophotographic photosensitive members were produced in the same manner as in Example 19. Next, the surface of the respective electrophotographic photosensitive members was processed in the same manner as in Examples 2 to 18. Further, the properties of the electrophotographic photosensitive members were evaluated in the same manner as in Example 1. The results are shown in Table 1.

Example 37

A conductive layer, an intermediate layer and a charge generating layer were formed on a support in the same manner as in Example 1.

Next, the following components were dissolved in a mixed solvent of 600 parts of chlorobenzene and 200 parts of methylal to prepare a charge transporting layer coating solution. Using this solution, a charge transporting layer was applied on the charge generating layer by dip coating. Heat drying was then carried out for 30 minutes in an oven heated to 110° C., to form a charge transporting layer with an average layer thickness of 20 μm at a position 170 mm from the support upper end.

| | |
|---|---|
| Hole transporting materialrepresented by the above formula (1-5) | 50 parts |
| Copolymer type polyarylate resin represented by the following structural formula (4) | 100 parts |

(4)

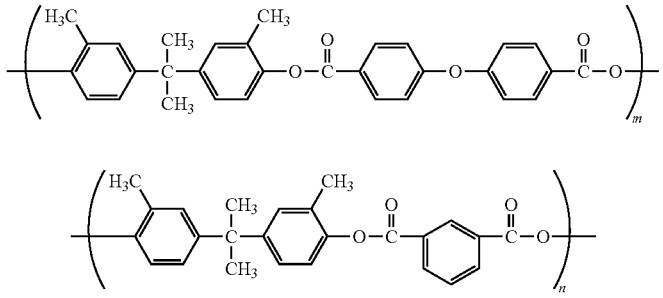

(In the formula, m and n represent the ratio (copolymerization ratio) of repeating units in this resin. In this resin, m:n is 7:3.)

Further, the weight average molecular weight (Mw) of this polyarylate resin is 120,000.

The surface of the thus-produced electrophotographic photosensitive member was subjected to the same processing as in Example 1 using the mold used in Example 2. It was confirmed by measuring the surface profile in the same manner as in Example 1 that conical depressed portions were formed. The measurement results are shown in Table 1. Further, the depressed portions were formed at 0.5 μm intervals, and the area ratio was calculated to be 20%. In addition, the properties of the electrophotographic photosensitive member were evaluated in the same manner as in Example 1. The results are shown in Table 1.

Example 38

An electrophotographic photosensitive member was produced in the same manner as in Example 37. Next, using the mold used in Example 3, the surface of the electrophotographic photosensitive member was subjected to the same processing as in Example 1. It was confirmed by measuring the surface profile in the same manner as in Example 1 that conical depressed portions were formed. The measurement results are shown in Table 1. Further, the depressed portions were formed at 0.2 μm intervals, and the area ratio was calculated to be 20%. In addition, the properties of the electrophotographic photosensitive member were evaluated in the same manner as in Example 1. The results are shown in Table 1.

Example 39

An electrophotographic photosensitive member was produced in the same manner as in Example 37. Next, using the mold used in Example 4, the surface of the electrophotographic photosensitive member was subjected to the same processing as in Example 1. It was confirmed by measuring the surface profile in the same manner as in Example 1 that conical depressed portions were formed. The measurement results are shown in Table 1. Further, the depressed portions were formed at 0.1 μm intervals, and the area ratio was calculated to be 20%. In addition, the properties of the electrophotographic photosensitive member were evaluated in the same manner as in Example 1. The results are shown in Table 1.

Example 40

A conductive layer, an intermediate layer and a charge generating layer were formed on a support in the same manner as in Example 1.

Next, the following components were dissolved in a mixed solvent of 600 parts of chlorobenzene and 200 parts of methylal to prepare a charge transporting layer coating solution. Using this solution, a charge transporting layer was applied on the charge generating layer by dip coating. Heat drying was then carried out for 30 minutes in an oven heated to 110° C., to form a charge transporting layer with an average layer thickness of 20 μm at a position 170 mm from the support upper end.

| | |
|---|---|
| Hole transporting material represented by the above formula (1-7) | 50 parts |
| Polyarylate resin represented by the above structural formula (3) | 100 parts |

The weight average molecular weight (Mw) of this polyarylate resin is 130,000.

The surface of the thus-produced electrophotographic photosensitive member was subjected to the same processing as in Example 1. It was confirmed by measuring the surface profile in the same manner as in Example 1 that conical depressed portions were formed. The measurement results are shown in Table 1. Further, the depressed portions were formed at 1.0 μm intervals, and the area ratio was calculated to be 20%. In addition, the properties of the electrophotographic photosensitive member were evaluated in the same manner as in Example 1. The results are shown in Table 1.

Examples 41 to 54

Electrophotographic photosensitive members were produced in the same manner as in Example 40. Next, the surface of the respective electrophotographic photosensitive members was processed in the same manner as in Examples 2 to 15. Further, the properties of the electrophotographic photosensitive members were evaluated in the same manner as in Example 1. The results are shown in Table 1.

Example 55

An electrophotographic photosensitive member was produced in the same manner as in Example 40. Next, the surface of the electrophotographic photosensitive member was processed in the same manner as in Example 18. Further, the properties of the electrophotographic photosensitive members were evaluated in the same manner as in Example 1. The results are shown in Table 1.

Comparative Example 1

An electrophotographic photosensitive member was produced in the same manner as in Example 1, except that the hole transporting material of Example 1 was changed to the following structural formula (5). Moreover, the electrophotographic photosensitive member was not subjected to surface processing. The properties of the electrophotographic photosensitive members were evaluated in the same manner as in Example 1. The results are shown in Table 1.

Formula 14

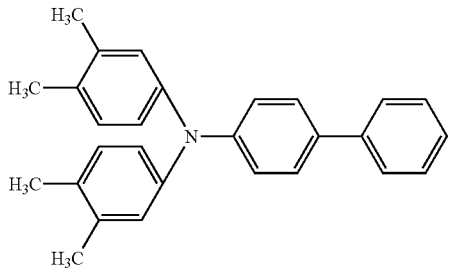

(5)

Comparative Example 2

An electrophotographic photosensitive member was produced in the same manner as in Comparative Example 1. Next, the electrophotographic photosensitive member was subjected to surface processing in the same manner as in Example 18. The properties of the electrophotographic photosensitive members were evaluated in the same manner as in Example 1. The results are shown in Table 1.

Comparative Example 3

An electrophotographic photosensitive member was produced in the same manner as in Comparative Example 1. Next, the electrophotographic photosensitive member was subjected to surface processing in the same manner as in Example 2. The properties of the electrophotographic photosensitive members were evaluated in the same manner as in Example 1. The results are shown in Table 1.

Comparative Example 4

A conductive layer, an intermediate layer and a charge generating layer were produced on a support in the same manner as in Example 1.

Next, the below-described components were dissolved in 600 parts of tetrahydrofuran, and the resultant solution was mixed to prepare a silica particle dispersion.

| | |
|---|---|
| Silica particles having a primary particle size of 0.1 μm | 50 parts |
| Polycarbonate resin ("Iupilon Z400"; manufactured by Mitsubishi Engineering-Plastics Corporation) | 50 parts |

This liquid was dispersed using a high-pressure dispersion machine ("Microfluidizer M-110"; manufactured by Mizuho Industrial Co., Ltd.). The dispersion was carried out three times at a dispersive pressure of 50 MPa.

Using the above-described dispersion, a charge transporting layer coating solution was prepared so as to have the following components. Using this solution, a charge transporting layer was applied on the charge generating layer by dip coating. Heat drying was then carried out for 30 minutes in an oven heated to 110° C., to form a charge transporting layer with an average layer thickness of 20 μm at a position 170 mm from the support upper end.

| | |
|---|---|
| Hole transporting material represented by the above structural formula (1-7) | 50 parts |
| Polycarbonate resin ("Iupilon Z400"; manufactured by Mitsubishi Engineering-Plastics Corporation) | 100 parts |
| Silica particles having a primary particle size of 0.1 μm | 20 parts |
| Chlorobenzene | 400 parts |
| Tetrahydrofuran | 400 parts |

The properties of the thus-produced electrophotographic photosensitive member were evaluated in the same manner as in Example 1. The results are shown in Table 1.

Reference Example 1

An electrophotographic photosensitive member was produced in the same manner as in Example 1. Next, the surface of the electrophotographic photosensitive member was subjected to the same processing as in Example 1, except that, in the mold used for Example 1, the minor axis diameter indicated by D in FIG. 10 was changed from 1.0 μm to 3.0 μm, the interval indicated by E in FIG. 10 was changed from 1.0 μm to 3.0 μm, and the height indicated by F in FIG. 10 was changed from 0.8 μm to 8.0 μm. It was confirmed by measuring the surface profile in the same manner as in Example 1 that conical depressed portions were formed. The measurement results are shown in Table 1. Further, the depressed portions were formed at 3.0 μm intervals, and the area ratio was calculated to be 20%. The properties of the electrophotographic photosensitive member were evaluated in the same manner as in Example 1. The results are shown in Table 1.

TABLE 1

| | Rpc | Rdv | Rdv/Rpc | CTM | Ionization potential | Number | Area ratio | Friction memory | Plus charge (V) | Plu charge decrement ratio (%) |
|---|---|---|---|---|---|---|---|---|---|---|
| Example 1 | 1 | 0.4 | 0.4 | 1-5 | 5.1 | 2500 | 20 | A | 50 | 24 |
| Example 2 | 0.5 | 0.2 | 0.4 | ↑ | ↑ | 10000 | 20 | A | 50 | 26 |
| Example 3 | 0.2 | 0.08 | 0.4 | ↑ | ↑ | 62500 | 20 | A | 50 | 26 |
| Example 4 | 0.1 | 0.04 | 0.4 | ↑ | ↑ | 250000 | 20 | A | 50 | 26 |
| Example 5 | 0.05 | 0.02 | 0.4 | ↑ | ↑ | 1000000 | 20 | A | 50 | 26 |
| Example 6 | 2 | 0.8 | 0.4 | ↑ | ↑ | 625 | 20 | A | 50 | 22 |
| Example 7 | 3 | 1.2 | 0.4 | ↑ | ↑ | 256 | 20 | B | 50 | 20 |
| Example 8 | 3 | 3 | 1 | ↑ | ↑ | 256 | 20 | B | 46 | 18 |
| Example 9 | 0.5 | 0.4 | 0.8 | ↑ | ↑ | 10000 | 20 | A | 48 | 22 |
| Example 10 | 0.5 | 0.1 | 0.2 | ↑ | ↑ | 10000 | 20 | A | 50 | 26 |
| Example 11 | 0.5 | 0.05 | 0.1 | ↑ | ↑ | 10000 | 20 | A | 50 | 26 |
| Example 12 | 0.5 | 0.2 | 0.4 | ↑ | ↑ | 8100 | 16 | B | 50 | 20 |
| Example 13 | 0.5 | 0.2 | 0.4 | ↑ | ↑ | 15625 | 31 | A | 50 | 28 |
| Example 14 | 0.5 | 0.2 | 0.4 | ↑ | ↑ | 10000 | 20 | A | 50 | 26 |
| Example 15 | 0.5 | 0.1 | 0.2 | ↑ | ↑ | 10000 | 25 | A | 50 | 26 |
| Example 16 | 0.5 | 0.2 | 0.4 | 1-9 | 5.3 | 10000 | 20 | B | 50 | 18 |
| Example 17 | 0.5 | 0.2 | 0.4 | 1-2 | 5.2 | 10000 | 20 | A | 50 | 24 |
| Example 18 | 3 | 1.5 | 0.5 | 1-5 | 5.1 | 100 | 4 | C | 50 | 14 |
| Example 19 | 1 | 0.4 | 0.4 | ↑ | ↑ | 2500 | 20 | A | 50 | 24 |
| Example 20 | 0.5 | 0.2 | 0.4 | ↑ | ↑ | 10000 | 20 | A | 50 | 26 |
| Example 21 | 0.2 | 0.08 | 0.4 | ↑ | ↑ | 62500 | 20 | A | 50 | 28 |
| Example 22 | 0.1 | 0.04 | 0.4 | ↑ | ↑ | 250000 | 20 | A | 50 | 28 |
| Example 23 | 0.05 | 0.02 | 0.4 | ↑ | ↑ | 1000000 | 20 | A | 50 | 28 |

TABLE 1-continued

| | Rpc | Rdv | Rdv/ Rpc | CTM | Ionization potential | Number | Area ratio | Friction memory | Plus charge (V) | Plu charge decrement ratio (%) |
|---|---|---|---|---|---|---|---|---|---|---|
| Example 24 | 2 | 0.8 | 0.4 | ↑ | ↑ | 625 | 20 | A | 50 | 24 |
| Example 25 | 3 | 1.2 | 0.4 | ↑ | ↑ | 256 | 20 | A | 50 | 22 |
| Example 26 | 3 | 3 | 1 | ↑ | ↑ | 256 | 20 | A | 46 | 20 |
| Example 27 | 0.5 | 0.4 | 0.8 | ↑ | ↑ | 10000 | 20 | A | 48 | 22 |
| Example 28 | 0.5 | 0.1 | 0.2 | ↑ | ↑ | 10000 | 20 | A | 50 | 26 |
| Example 29 | 0.5 | 0.05 | 0.1 | ↑ | ↑ | 10000 | 20 | A | 50 | 26 |
| Example 30 | 0.5 | 0.2 | 0.4 | ↑ | ↑ | 8100 | 16 | A | 50 | 24 |
| Example 31 | 0.5 | 0.2 | 0.4 | ↑ | ↑ | 15625 | 31 | A | 50 | 30 |
| Example 32 | 0.5 | 0.2 | 0.4 | ↑ | ↑ | 10000 | 20 | A | 50 | 26 |
| Example 33 | 0.5 | 0.1 | 0.2 | ↑ | ↑ | 10000 | 25 | A | 50 | 28 |
| Example 34 | 0.5 | 0.2 | 0.4 | 1-9 | 5.3 | 10000 | 20 | A | 50 | 22 |
| Example 35 | 0.5 | 0.2 | 0.4 | 1-2 | 5.2 | 10000 | 20 | A | 47 | 20 |
| Example 36 | 3 | 1.5 | 0.5 | 1-5 | 5.1 | 100 | 4 | C | 50 | 14 |
| Example 37 | 0.5 | 0.2 | 0.4 | ↑ | ↑ | 10000 | 20 | A | 50 | 26 |
| Example 38 | 0.2 | 0.08 | 0.4 | ↑ | ↑ | 62500 | 20 | A | 50 | 28 |
| Example 39 | 0.1 | 0.04 | 0.4 | ↑ | ↑ | 250000 | 20 | A | 50 | 28 |
| Example 40 | 1 | 0.4 | 0.4 | 1-7 | 5.0 | 2500 | 20 | A | 50 | 24 |
| Example 41 | 0.5 | 0.2 | 0.4 | ↑ | ↑ | 10000 | 20 | A | 50 | 26 |
| Example 42 | 0.2 | 0.08 | 0.4 | ↑ | ↑ | 62500 | 20 | A | 50 | 28 |
| Example 43 | 0.1 | 0.04 | 0.4 | ↑ | ↑ | 250000 | 20 | A | 50 | 28 |
| Example 44 | 0.05 | 0.02 | 0.4 | ↑ | ↑ | 1000000 | 20 | A | 50 | 28 |
| Example 45 | 2 | 0.8 | 0.4 | ↑ | ↑ | 625 | 20 | A | 50 | 24 |
| Example 46 | 3 | 1.2 | 0.4 | ↑ | ↑ | 256 | 20 | A | 50 | 22 |
| Example 47 | 3 | 3 | 1 | ↑ | ↑ | 256 | 20 | A | 47 | 20 |
| Example 48 | 0.5 | 0.4 | 0.8 | ↑ | ↑ | 10000 | 20 | A | 48 | 22 |
| Example 49 | 0.5 | 0.1 | 0.2 | ↑ | ↑ | 10000 | 20 | A | 50 | 26 |
| Example 50 | 0.5 | 0.05 | 0.1 | ↑ | ↑ | 10000 | 20 | A | 50 | 26 |
| Example 51 | 0.5 | 0.2 | 0.4 | ↑ | ↑ | 8100 | 16 | A | 50 | 24 |
| Example 52 | 0.5 | 0.2 | 0.4 | ↑ | ↑ | 15625 | 31 | A | 50 | 30 |
| Example 53 | 0.5 | 0.2 | 0.4 | ↑ | ↑ | 10000 | 20 | A | 50 | 26 |
| Example 54 | 0.5 | 0.1 | 0.2 | ↑ | ↑ | 10000 | 25 | A | 50 | 28 |
| Example 55 | 3 | 1.5 | 0.5 | ↑ | ↑ | 100 | 4 | C | 50 | 14 |
| Comparative Example 1 | | | | 5 | 5.4 | 0 | | D | 50 | 10 |
| Comparative Example 2 | 3 | 1.2 | 0.4 | ↑ | 5.4 | 100 | 4 | D | 50 | 10 |
| Comparative Example 3 | 0.5 | 0.2 | 0.4 | ↑ | 5.4 | 10000 | 20 | C | 50 | 12 |
| Comparative Example 4 | | | | 1-7 | 5.0 | | | D | 50 | 8 |
| Reference Example | 3 | 4 | 1.3 | 1-5 | 5.1 | 256 | 20 | B | 40 | 10 |

By comparing Examples 1 to 55 of the present invention and Comparative Examples 1 to 4, the above results demonstrate that the friction memory of an electrophotographic photosensitive member having depressed portions with a ratio of depth to minor axis diameter (Rdv/Rpc) on a surface of the electrophotographic photosensitive member of 1.0 or less, and a hole transporting material with an ionization potential of 5.3 eV or less, can be improved From the results of plus charge decrement ratio of the electrophotographic photosensitive member having the depressed portions of the present invention and a hole transporting material with an ionization potential of 5.3 eV, it can be seen that for an electrophotographic photosensitive member having the depressed portions of the present invention and a hole transporting material with an ionization potential of 5.3 eV or less, the plus charge is effectively reduced.

Comparing Example 8 and Reference Example 1, it can be seen that Reference Example 1 has a smaller plus charge decrement ratio, which is a characteristic of the present invention, than Example 8, so that the effect of the present invention could not be obtained. This is thought to be due to the fact that since the depressed portions of Reference Example 1 are deep, the contact area with the charge member is reduced, so that the plus charge region generated on the photosensitive member is smaller.

Example 56

Figure 16:
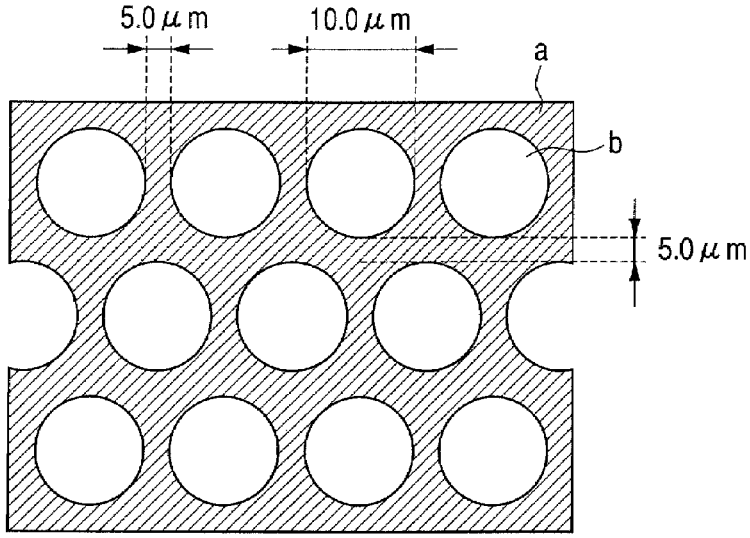
FIG. 16 is a view illustrating the profile of the mold (partial enlarged view) used in Example 56.
Figure 17:
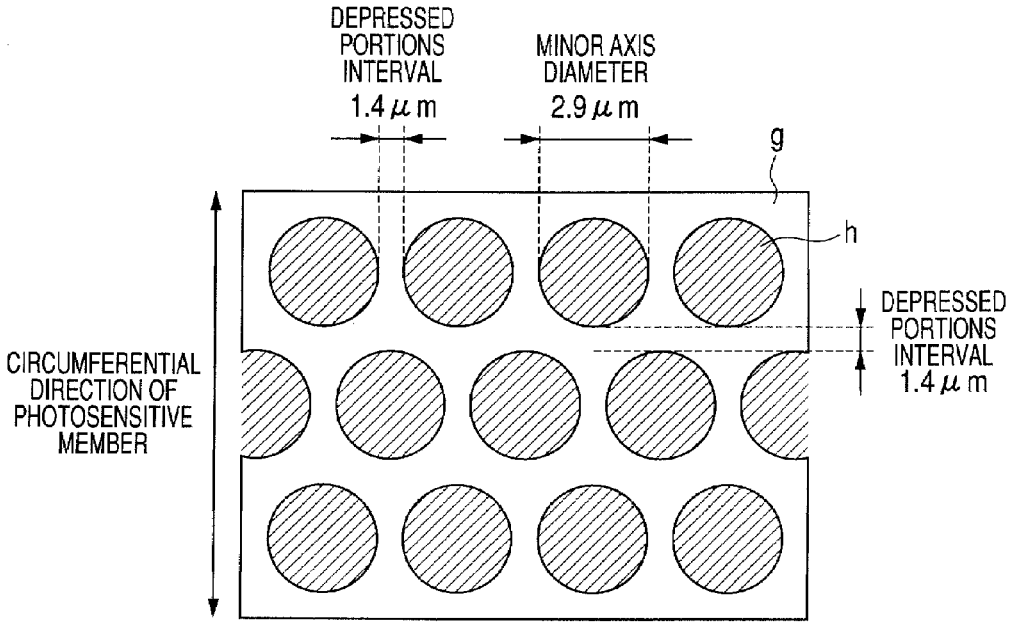
FIG. 17 is a view illustrating the array pattern of the depressed portions (partial enlarged view) of the photosensitive member outermost surface obtained from Example 56.

An electrophotographic photosensitive member was produced in the same manner as that in Example 1. Depressed portions were formed on the surface of the obtained electrophotographic photosensitive member using a depressed portion forming method employing a KrF excimer laser (wavelength $\lambda$=248 nm) like that illustrated in FIG. 4. Here, a mask made of quartz glass was used which had a pattern in which circular laser light transmitting areas of 10 μm in diameter as illustrated in FIG. 16 were arranged at intervals of 5.0 μm as illustrated in the drawing. Irradiation energy was set at 0.9 J/cm$^3$. Further, an area of 2 mm square was irradiated per irradiation, and the laser light irradiation was carried out once per 2 mm square irradiation section. The same depressed portions were produced by a method in which, as illustrated in FIG. 4, the electrophotographic photosensitive member was rotated and the irradiation position was shifted in its axial direction, so that the depressed portions were formed on the photosensitive member surface. Further, the produced photosensitive member was heat treated for 30 minutes in an oven heated to 120° C. It was confirmed by measuring the surface profile in the same manner as in Example 1 that the depressed portions illustrated in FIG. 17 were formed. The measurement results are shown in Table 2. Further, the depressed portions were formed at 1.4 μm intervals, and the area ratio was 41%. The properties of the electrophotographic photosensitive member were evaluated in the same manner as in Example 1. The results are shown in Table 2.

Example 57

Figure 18:
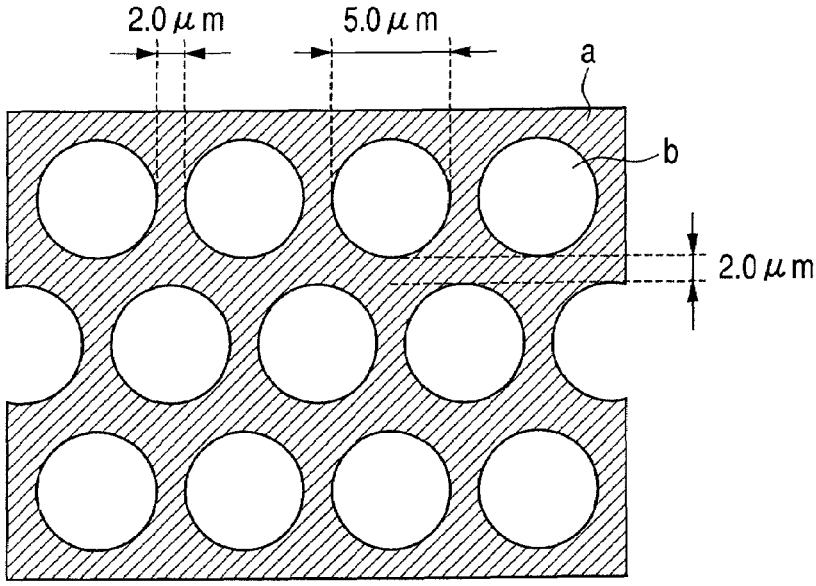
FIG. 18 is a view illustrating the array pattern of the mask (partial enlarged view) used in Example 57.
Figure 19:
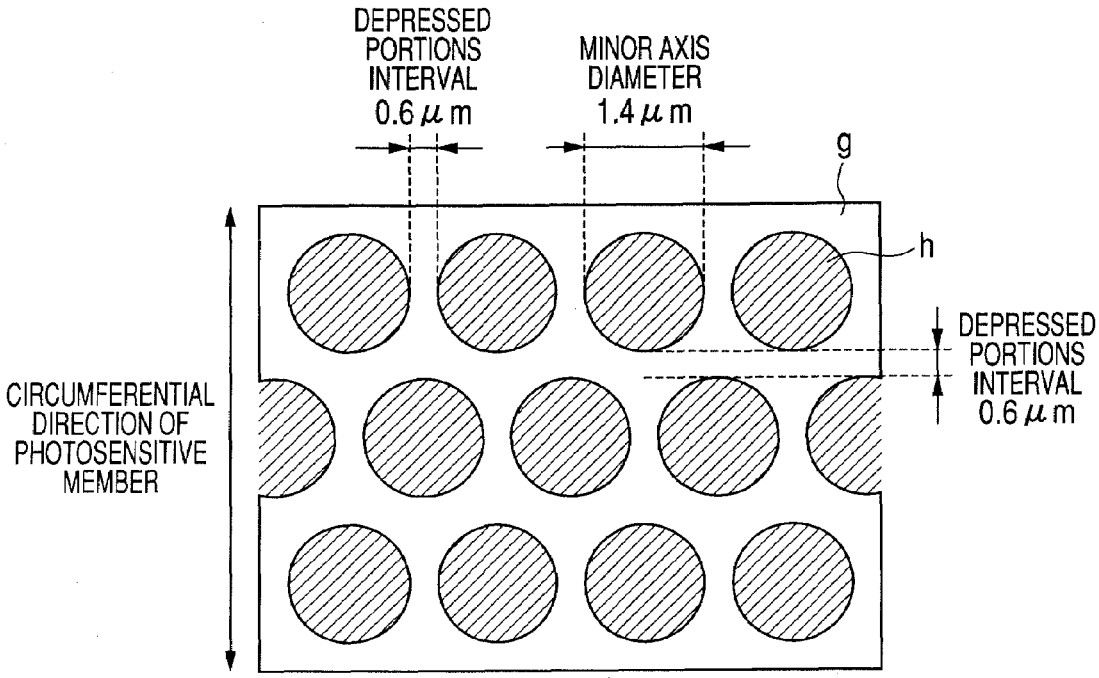
FIG. 19 is a view illustrating the array pattern of the depressed portions (partial enlarged view) of the photosensitive member outermost surface obtained from Example 57.

An electrophotographic photosensitive member was produced in the same manner as in Example 1. Surface profile formation was carried out in the same manner as in Example 56, except that a mask made of quartz glass was used which had a pattern in which circular laser light transmitting areas of 5.0 μm in diameter as illustrated in FIG. 18 were arranged at intervals of 2.0 μm as illustrated in the drawing. It was confirmed by measuring the surface profile in the same manner as in Example 1 that the depressed portions illustrated in FIG. 19 were formed. The measurement results are shown in Table 2. Further, the depressed portions were formed at 0.6 μm intervals, and the area ratio was 44%. The properties of the electrophotographic photosensitive member were evaluated in the same manner as in Example 1. The results are shown in Table 2.

Example 58

A conductive layer, an intermediate layer and a charge generating layer were formed on a support in the same manner as in Example 1.

Next, the same surface layer coating solution as in Example 1 was applied on the charge generating layer by dip coating to coat the support with the surface layer coating solution. The step of coating with the surface layer coating solution was carried out under conditions of a relative humidity of 45% and an atmospheric temperature of 25° C. 180 seconds after the coating step was completed, the support applied with the surface layer coating solution was held for 30 seconds in a condensation-step apparatus. The interior of this apparatus had been previously set to a relative humidity of 70% and an atmospheric temperature of 45° C. 60 seconds after the condensation step was completed, the support was put into an air blow dryer, the interior of which having been pre-heated to 120° C., to carry out the drying step for 60 minutes. An electrophotographic photosensitive member was thus produced having a charge transport layer as its surface layer. The average layer thickness at a position 170 mm from the support upper end was 20 μm.

It was confirmed by measuring the surface profile in the same manner as in Example 1 that depressed portions were formed. The measurement results are shown in Table 2. Further, the depressed portions were formed at 0.6 μm intervals, and the area ratio was 46%. The properties of the electrophotographic photosensitive member were evaluated in the same manner as in Example 1. The results are shown in Table 2.

Example 59

A conductive layer, an intermediate layer and a charge generating layer were formed on a support in the same manner as in Example 1.

Next, the same surface layer coating solution as in Example 19 was applied on the charge generating layer by dip coating to coat the support with the surface layer coating solution. The step of coating with the surface layer coating solution was carried out under conditions of a relative humidity of 45% and an atmospheric temperature of 25° C. 180 seconds after the coating step was completed, the support applied with the surface layer coating solution was held for 30 seconds in a condensation-step apparatus. The interior of this apparatus had been previously set to a relative humidity of 70% and an atmospheric temperature of 45° C. 60 seconds after the condensation step was completed, the support was put into an air blow dryer, the interior of which having been pre-heated to 120° C., to carry out the drying step for 60 minutes. An electrophotographic photosensitive member was thus produced having a charge transport layer as its surface layer. The average layer thickness at a position 170 mm from the support upper end was 20 μm.

It was confirmed by measuring the surface profile in the same manner as in Example 1 that depressed portions were formed. The measurement results are shown in Table 2. Further, the depressed portions were formed at 0.6 μm intervals, and the area ratio was 45%. The properties of the electrophotographic photosensitive member were evaluated in the same manner as in Example 1. The results are shown in Table 2.

Example 60

A conductive layer, an intermediate layer and a charge generating layer were formed on a support in the same manner as in Example 1.

Next, the same surface layer coating solution as in Example 40 was applied on the charge generating layer by dip coating to coat the support with the surface layer coating solution. The step of coating with the surface layer coating solution was carried out under conditions of a relative humidity of 45% and an atmospheric temperature of 25° C. 180 seconds after the coating step was completed, the support applied with the surface layer coating solution was held for 30 seconds in a condensation-step apparatus. The interior of this apparatus had been previously set to a relative humidity of 70% and an atmospheric temperature of 45° C. 60 seconds after the condensation step was completed, the support was put into an air blow dryer, the interior of which having been pre-heated to 120° C., to carry out the drying step for 60 minutes.

An electrophotographic photosensitive member was thus produced having a charge transport layer as its surface layer. The average layer thickness at a position 170 mm from the support upper end was 20 μm.

It was confirmed by measuring the surface profile in the same manner as in Example 1 that depressed portions were formed. The measurement results are shown in Table 2. Further, the depressed portions were formed at 0.6 μm intervals, and the area ratio was 45%. The properties of the electrophotographic photosensitive member were evaluated in the same manner as in Example 1. The results are shown in Table 2.

TABLE 2

| | Rpc | Rdv | Rdv/Rpc | CTM | Ionization potential | Number | Area ratio | Friction memory | Plus charge (V) | Plus charge decrement ratio (%) |
|---|---|---|---|---|---|---|---|---|---|---|
| Example 56 | 2.9 | 1 | 0.34 | 1-5 | 5.1 | 625 | 41 | A | 50 | 30 |
| Example 57 | 1.4 | 1.1 | 0.79 | ↑ | ↑ | 2890 | 44 | A | 46 | 28 |
| Example 58 | 1.5 | 0.6 | 0.4 | ↑ | ↑ | 2600 | 46 | A | 50 | 34 |
| Example 59 | 1.5 | 0.5 | 0.33 | ↑ | ↑ | 2600 | 45 | A | 50 | 34 |
| Example 60 | 1.5 | 0.5 | 0.33 | 1-7 | 5.0 | 2600 | 45 | A | 50 | 36 |

From the results of Examples 56 to 60, it can be seen that the friction memory of an electrophotographic photosensitive member can be improved by having a ratio of depth to minor axis diameter (Rdv/Rpc) on a surface of the electrophotographic photosensitive member of 1.0 or less, and a hole transporting material with an ionization potential of 5.3 eV or less.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-080967, filed Mar. 27, 2007, which is hereby incorporated by reference herein in its entirety.

What is claimed is:

1. An electrophotographic photosensitive member comprising a photosensitive layer on a support, wherein the electrophotographic photosensitive member has 100 or more depressed portions which are independent from one another per unit area (100 μm×100 μm) over the whole surface of a surface layer;

where the minor axis diameter of the depressed portions is Rpc and the depth indicating the distance between the innermost part of a depressed portion and the opening surface thereof is Rdv, the depressed portions have a ratio of depth to minor axis diameter (Rdv/Rpc) of 1.0 or less; and the photosensitive layer comprises a hole transporting material with an ionization potential of 4.5 eV or more and 5.3 eV or less.

2. The electrophotographic photosensitive member according to claim 1, wherein the ratio of average depth Rdv to minor axis diameter Rpc (Rdv/Rpc) of the depressed portions is 0.10 or more and 0.40 or less.

3. The electrophotographic photosensitive member according to claim 1, wherein the depth Rdv of the depressed portions is 0.01 μm or more and 3.00 μm or less.

4. The electrophotographic photosensitive member according to claim 3, wherein the depth Rdv of the depressed portions is 0.05 μm or more and 1.20 μm or less.

5. The electrophotographic photosensitive member according to claim 1, wherein the surface of the electrophotographic photosensitive member has 250 or more and 1,000,000 or less depressed portions per unit area (100 μm×100 μm).

6. The electrophotographic photosensitive member according to claim 1, wherein an opening area ratio of the depressed portions is 16% or more.

7. The electrophotographic photosensitive member according to 6, wherein an opening area ratio of the depressed portions is 20% or more and 50% or less.

8. A process cartridge, integrally supporting on a support the electrophotographic photosensitive member according to claim 1 and at least one device selected from the group consisting of a charging device, a developing device and a cleaning device, the process cartridge being freely detachable/mountable to a main body of an electrophotographic apparatus.

9. An electrophotographic apparatus comprising the electrophotographic photosensitive member according to claim 1, a charging device, an exposure device, a developing device and a transfer device.

* * * * *